US007331147B2

(12) United States Patent
Kalisiak et al.

(10) Patent No.: US 7,331,147 B2
(45) Date of Patent: Feb. 19, 2008

(54) HEXAGONAL PAVING PANEL

(75) Inventors: Jerzy Kalisiak, Warsaw (PL); Jerzy Szulc, Kowicz (PL)

(73) Assignee: Jerzy Kalisiak, Warzawa (PL)

( * ) Notice: Subject to any disclaimer, the term of this patent is extended or adjusted under 35 U.S.C. 154(b) by 656 days.

(21) Appl. No.: 10/489,540

(22) PCT Filed: Sep. 5, 2002

(86) PCT No.: PCT/PL02/00066

§ 371 (c)(1),
(2), (4) Date: Mar. 12, 2004

(87) PCT Pub. No.: WO03/023145

PCT Pub. Date: Mar. 20, 2003

(65) Prior Publication Data

US 2004/0244320 A1 Dec. 9, 2004

(30) Foreign Application Priority Data

Sep. 13, 2001 (PL) ..... 349655
May 6, 2002 (PL) ..... 353719

(51) Int. Cl.
*E04F 13/08* (2006.01)

(52) U.S. Cl. ..... 52/385; 52/177; 52/387; 52/180

(58) Field of Classification Search ..... 52/385, 52/177, 180, 181, 387
See application file for complete search history.

(56) References Cited

U.S. PATENT DOCUMENTS 4,963,055 A * 10/1990 Sims, Jr. ..... 404/41

(Continued)

FOREIGN PATENT DOCUMENTS

CA 2091036 5/1994

(Continued)

OTHER PUBLICATIONS

International Search Report dated Jan. 14, 2003, for corresponding international patent application No. PCT/PL02/00066.

*Primary Examiner*—Basil Katcheves
(74) *Attorney, Agent, or Firm*—Brinks Hofer Gilson & Lione

(57) ABSTRACT

A hexagonal paving panel, the sides of which are alternately provided with upper and lower connecting elements in the form of tab or overlap elements (102, 103) and fixing pins. The panel (100) is provided with a central aperture (109) and with a downwardly extending collar (101) on its periphery. The central aperture serves as a drain hole, stabilizes the panel on a ground and improves storage of the panels in a stack. The bottom surface (114) of the panel is provided with recesses (20) having small depth and large obtuse angle, while the top surface is anti-slip. Upper overlap elements (103) alternately protrude from sides of the panel beyond the collar (101) while lower overlap elements (103) are formed by reduction of thickness of the collar. Each upper overlap element (102) is provided with connecting holes (105) and each lower overlap element (103) is provided with correspondingly shaped upright connecting protrusions (106) which enter into connecting holes (105) of the upper overlap element (102) of the adjacent panel. Panels are interconnected by clip-pins (116), removable with use of a disassembly tool (121). Borders of road surface laid out of the panels are covered with finishing strips (123). The panels may be produced entirely of plastics, mostly waste or recycled, or of rubber and skeleton frame. The panels are destined for covering yards, roads and walkways without special preparation of the ground base. The panels may carry substantial loads in a wide range of temperatures, between −30° C. and +60° C.

40 Claims, 17 Drawing Sheets

U.S. PATENT DOCUMENTS

| | | | | |
|---|---|---|---|---|
| 5,527,128 | A | 6/1996 | Rope et al. | |
| 5,833,386 | A * | 11/1998 | Rosan et al. | 404/36 |
| 6,966,161 | B2 * | 11/2005 | Palsson et al. | 52/589.1 |

FOREIGN PATENT DOCUMENTS

| | | | |
|---|---|---|---|
| DE | 41 43 419 | A1 | 12/1993 |
| DE | 94 07 901 | | 10/1994 |
| DE | 196 40 128 | A1 | 4/1998 |
| EP | 0 224 095 | B1 | 6/1987 |
| EP | 0 621 373 | A2 | 10/1994 |
| FR | 2 559 177 | A1 | 8/1985 |
| JP | 9296408 | | 11/1997 |
| PL | 52531 | | 1/1967 |
| PL | 113473 | | 4/1982 |

* cited by examiner 10
12
13
11
16
d
r
w 10
13
11
14
12
15
d1
d2

HEXAGONAL PAVING PANEL

FIELD OF THE INVENTION

This invention relates to a hexagonal paving panel, the sides of which are alternately provided with upper and lower connecting elements being formed by thickness reduction of the border of the paving panel and provided with a fixing hole for a fixing pin. After connection of the panels, lower and upper connecting elements of one panel mate with the upper and lower connecting elements of adjacent panels. The panel is provided with a central aperture and with a downwardly extending collar on its periphery.

This invention also relates to a hexagonal paving panel, the sides of which are alternately provided with upper and lower connecting elements protruding from its sides beyond a downwardly extending peripheral collar, the upper elements having downwardly extending upper vertical arm, and the lower elements upwardly is extending lower vertical arm. Between the upper vertical arm and the peripheral collar is formed an upper cavity open from the bottom, and between the lower vertical arm and the side of the panel is formed a lower cavity open from the top, wherein the cavities and the vertical arms are approximately rectangular in a cross-section. After connection of the panels, being provided with a central aperture, lower and upper connecting elements of one panel mate with the upper and lower connecting elements of adjacent panels.

BACKGROUND OF THE INVENTION

Fairly often occurs a need to cover, temporarily or permanently, a ground with flooring, either to protect it or to provide a hard walk- or carriageway, for cultural events, on fairgrounds or construction sets. Building projects require temporary access roads and walkways. Elements used for such flooring purposes are most often made of plastics. User requirements include simple construction, low weight, simple and fast application and removal, easy transportation and storage combined with low production costs. Good adhesion to the base, high stability and mechanical properties are expected. In the state of the art, several concepts of surfacing elements for temporary walkways, roads and yards are known.

European patent EP 0 621 373 describes a ground covering, intended as a walk-on traffic surface area. The ground covering comprises coupled together hexagonal panels being provided on their sides with alternate hook protrusions and eyelet protrusions, interlocking after assembly. Mating surfaces of the connecting protrusions are rounded towards each other, allowing pivoting movement of the protrusions. Between adjacent sides of connected panels is a certain clearance. Each panel is designed as a thick-wall membrane with an anti-slip pattern on the upper surface. Such panels, however, cannot be applied on uneven, angled or muddy base, for example construction sites, since uneven loads may cause disconnecting of the joints and destruction of the floor.

French patent FR 2559177 describes standard hexagonal plate having edge hooks and eye-loops connection, for interlocking with others in a ground covering, such as emergency roadway. Underside of the plate comprises channels, which form diverging reinforcing ribs running out from the central point of the plate. Adjacent reinforcing ribs are connected together by a crack-preventive rib. The plate is made of aluminium-silicon alloy.

German patent DE 196 40 128 describes a floor lining comprising a rectangular plate with four sides of reduced thickness. The four sides are formed so as to be connected with neighbouring plates by a groove and tongue connection. Two opposite sides of the plate comprising the groove and the tongue, respectively, are provided with blind openings which form, together with fastening plugs, fixing elements, preventing lateral displacement of the plates. The floor lining is made of plastic material.

German utility model DE 94 07 901 describes a hexagonal paving panel being provided on their sides with alternate hook protrusions, interlocking after assembly. The panel comprises blind openings and pins with anti-slip heads being placed in the openings. Underside of the panel comprises reinforcing ribs.

Although described above panels are well adopted to certain applications, like industrial or emergency purposes, they can not be applied on uneven, angled or muddy base. Some of these constructions may cause difficulties during mounting and de-mounting or have insufficient mechanical properties or can be expensive in production.

German patent DE 41 43 419 relates to plastic hexagonal trays to form a patterned grass surface. Each tray has T-shaped hooks and cutouts, interlocking with adjacent plates as well as a large central opening. Between connected elements are provided gaps to drain off surface water.

Canadian patent CA 2 091 036 concerns triangular, rectangular and hexagonal surface elements, consisting of cores filled with wood chips, saw dust, foam or other loose material, enclosed in outer cover of thermoplastic or thermoset material. In particular the cover may be formed of glass-reinforced synthetic resin. The surface elements are designed for application on sands and feature downwardly extending flanges on their peripheries.

A modular roll-out portable floor and walkway comprising a plurality of interconnected covering panels of a lightweight plastic is known from U.S. Pat. No. 5,833,386 and U.S. Pat. No. 5,527,128. Each panel is rectangular and comprises two downwardly extending connecting elements and two upwardly extending connecting elements. The panels comprise water drainage channels or drain holes. Downwardly extending connecting elements of each panel have oblong grooves to serve as hinges permitting rolling interconnected panels up. Upper surfaces are provided with an anti-slip pattern.

Japanese patent JP 9296408 describes a rectangular synthetic resin surface panel intended particularly to be applied on a soft or muddy base. Longer sides of each panel have downwardly and upwardly extending connecting hooks, while shorter sides have flat protrusions and corresponding flat cut outs, respectively. Longer sides of each panel are also provided with vertical protuberances and corresponding recesses, respectively. Each panel has drain holes.

European patent EP 0 224 095 concerns a grid plate of plastic material to be applied in particular on grass covered ground in packing lots and on embankments. Each plate features on at least one side, close to its upper surface, upwardly extending small hooks mating with downwardly extending small hooks arranged on the other side. Each plate has a large central opening to pass growing grass through.

Concrete hexagonal elements for roads surfaces are known from Polish patents PL 52 531 and PL 113473.

The aim of the invention is to provide a hexagonal paving panel which would feature simple design and be inexpensive in production, easy to store and transport, pose and remove. On the other hand, it should provide good adhesion to various bases, sufficiently high mechanical properties and wide application scope, ranging from pedestrian walkways to motor transport surfaces.

SUMMARY OF THE INVENTION

According to a first aspect of the invention there is provided a hexagonal paving panel being characterized in that the lower surface of the paving panel is provided with shallow conical or prismatic recesses, and in that each overlap element of the connecting elements of the paving panel is provided with at least one fixing through-hole for a fixing pin.

In a preferred embodiment, each upper overlap element of the panel is provided with connecting holes and each lower overlap element is provided with correspondingly shaped upright connecting protrusions which enter into connecting holes of the upper overlap element of the adjacent panel. Advantageously, each upper overlap element is provided with two connecting holes and each lower overlap element is provided with two connecting protrusions, wherein between the two connecting holes and between the two connecting protrusions is located one upper and one lower fixing through-hole, respectively, for the fixing pin. Upper fixing through-hole is so shaped, that it extends conically in its upper and bottom parts, while the lower fixing hole is cylindrical, with diameter slightly smaller than the maximum diameter of the upper fixing through-hole.

Preferably, the panel is provided with a fixing pin in the form of a clip-pin comprising a conical head which fits into the upper part of the upper fixing through-hole, and resilient legs protruding from the head and ended with specially shaped tips, which, after connecting the panels, extend through the lower fixing through-hole of the adjacent panel and rest on the lower surface of the fixing through-hole. The number of resilient legs of the clip-pin amounts from two to six, preferably four.

Advantageously, the clip-pin is provided with a circumferential groove near the head. In a preferred embodiment, the panel is provided with a disassembly tool in the form of a bent rod with a handle and a flat tip entering into a narrow slot formed at the side of the upper fixing through-hole and in the circumferential groove on the clip-pin.

In a preferred embodiment, the panel is provided with a finishing strip, placed on the border of connected panels, wherein in the fixing holes of the strip and in the additional fixing holes of the panels, located close to the lower overlap element, is settled a clip-pin, which has preferably the same construction as the clip-pin for interconnecting adjacent panels, but greater length. The finishing strip has, on its oblong side, a vertical wall with a rounded corner, which enters onto the border of the panel, and a chamfered opposite oblong side, which constitutes a gentle passage between the upper surface of the panel and the upper surface of the strip.

The panel has a central aperture, which is preferably provided in its top part with a shallow flat recess and in its bottom part with a narrower frustoconical recess, connected with the flat recess by a narrow channel. The outer diameter of the sidewall of the central aperture is approximately the same as the diameter of the flat recess.

Advantageously, the panel has in its bottom at least one arrangement of blind openings, provided on the sidewall of the central aperture and/or on these parts of the collar, from which the lower overlap elements extend.

In accordance with another embodiment of the invention, the panel consists of a hexagonal frame produced of plastics and provided with radial bracing ribs, connecting the sidewall of the central aperture with corners of the frame, a reinforcement including a few coaxial steel wire coils extending through the holes in the bracing ribs, and a rubber filling.

According to a yet further embodiment of the invention, the panel consists of a hexagonal frame, made of sheetmetal, preferably steel, provided with a central part, with a hexagonal rim the outline of which is slightly smaller than that of a finished paving panel, and with radial bracing ribs, connecting the central part with corners of the hexagonal rim, then of a reinforcement, including a few coaxial steel wire coils extending through holes in the bracing ribs, and of a rubber filling, enveloping the frame of all sides and including all the constructional elements of the paving panel.

In the two last embodiments, the rubber filing consists of a rubber granulate, preferably obtained by grinding worn automobile tyres, mixed with hardening adhesive.

According to still another embodiment the panel has a central aperture, a sidewall of which is provided on its outer surface with an annular protrusion, and has a frustoconical shape, narrower in the lower part, and extends beyond the lower surface of the collar of the paving panel. The lower surface of the annular protrusion of the sidewall of the central aperture lies in the plane of the lower surface of the collar.

According to a second aspect of the invention there is provided a hexagonal paving panel being characterized in that the lower surface of the paving panel is provided with shallow conical or prismatic recesses, and in that the sidewall of the central aperture is provided on its outer surface with an annular protrusion, and has frustoconical shape, narrower in the lower part, and extends beyond the lower surface of the collar of the paving panel.

According to this aspects of the invention, the lower surface of the annular protrusion the sidewall of the central aperture lies in the plane of the lower surface of the collar.

By a preferred design of the paving panel in accordance with the invention the obtuse angle of the shallow conical or prismatic recesses measures from about 160° to about 170°. The ratio between the greatest thickness and the smallest thickness of the panel equals approximately 1.5.

In a particularly preferred embodiment of the invention, all of panel's elements are made of plastics being preferably received from waste or recycling, which contains 25% to 75% by weight of polypropylene and 75% to 25% by weight of polyethylene. Preferably, panel contains modifying agent in the quantity of 5% to 60% by weight in relation to the total mass of polypropylene and polyethylene. Modifying agent is preferably selected from the group consisting of chalk, talc and glass fibres.

It is preferred that the panel is made of polypropylene in the quantity of about 50% by weight, of polyethylene in the quantity of about 50% by weight, and of chalk in the quantity of 20% by weight in relation to the total mass of polypropylene and polyethylene.

Desirably, panel has a well visible marker, preferably a shallow groove extending between opposite corners of the panel.

Further, panel has an identification number on its top surface.

Advantage of the paving panel according to the invention is in its wide range of application possibilities, for construction of pedestrian walkways as well as motor traffic, including heavy vehicles, such as delivery vans. Application of such panels does not require any special preparation of a ground base and ensure easy posing and removal, requiring no heavy equipment and without disturbance to small architecture, like lawns.

A surface constructed of panels according to the invention provides good stability and adhesion to the base, efficient removal of precipitation water, simple storage and transport combined with environmental friendliness shown in the absence of pollution or waste, usage of recycled material: plastic and rubber, for example old tyres, and finally in possibility of reprocessing damaged panels. The design and material composition of the panels ensure lightweight and high load capacity over a wide range of temperatures (−30° C. to +60° C.). The panels are easy and cheap to produce and distribute.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF PREFERRED EMBODIMENTS

Figures 1A, 1B:
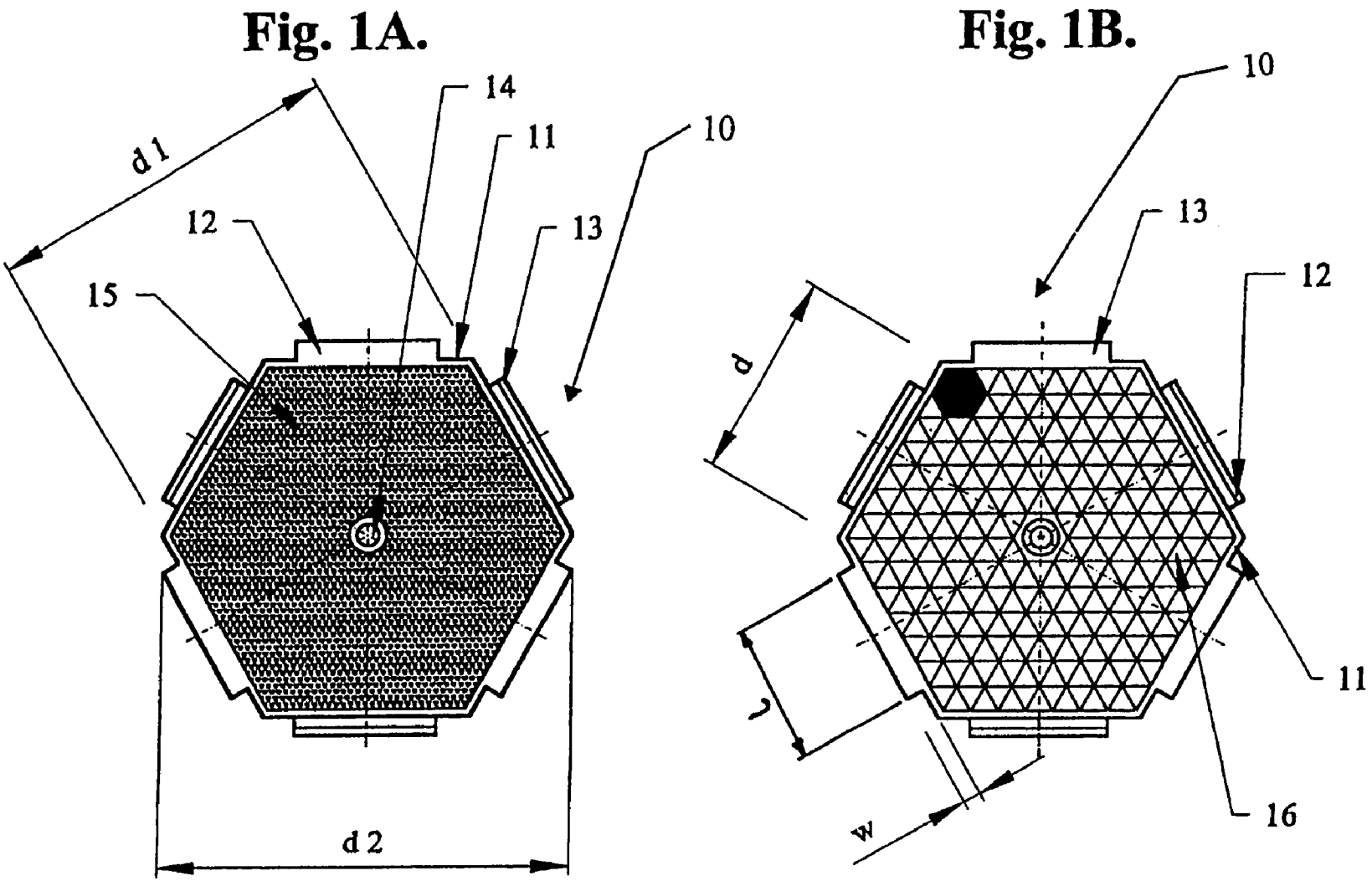
FIGS. 1A and 1B are top and bottom views, respectively, of a hexagonal plastic paving panel of the light type, comprising tab connecting elements.
Figure 2:
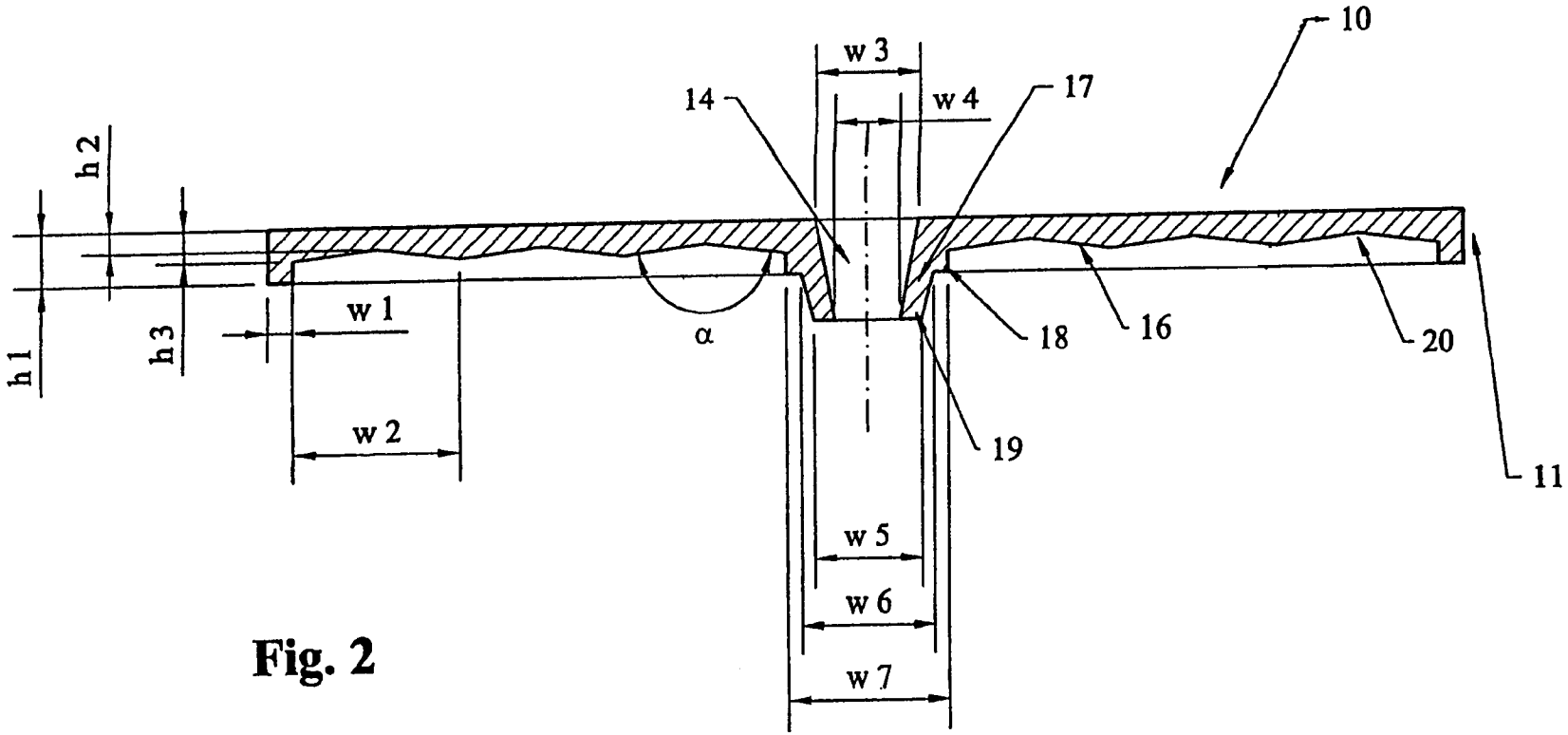
FIG. 2 is a sectional view of the panel of FIGS. 1A and 1B.
Figure 3:
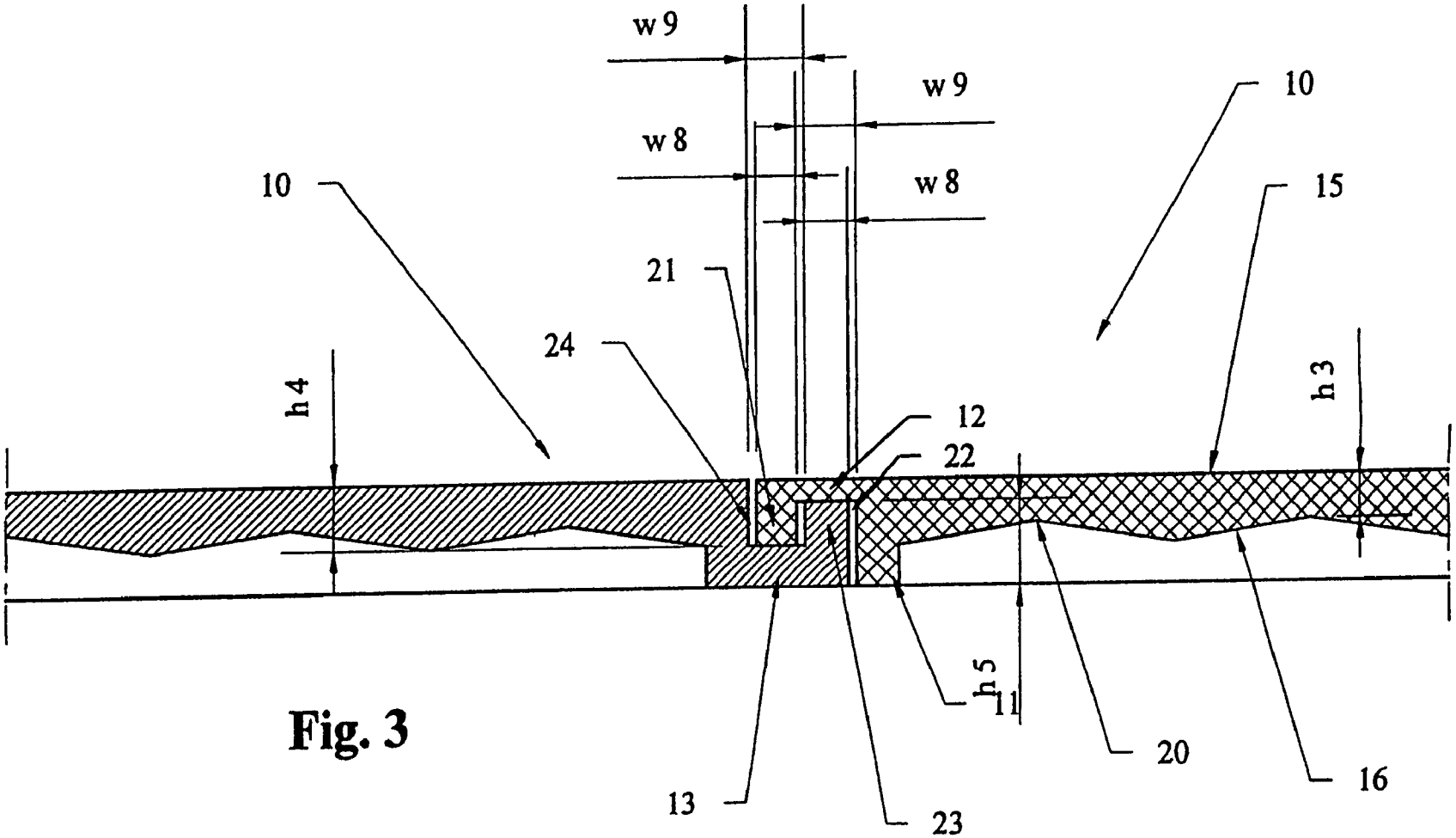
FIG. 3 is a sectional view of connection of two panels of FIGS. 1A and 1B.

Referring to FIGS. 1 to 3 there is shown a hexagonal paving panel 10 according to the invention, which is provided with a hook-type connecting arrangement. The panel 10 has in a plan view a shape of a regular hexagon and is formed as a one-piece plastics moulding, particularly from waste or recycled material. The paving panel 10 has on its periphery a downwardly extending peripheral collar 11. The panel 10 has on its sides alternately extending upper and lower tab elements 12 and 13. The length l of the tab elements 12 and 13 is between 50% and 80%, preferably between 60% and 70% of the side length d of the panel, providing a secure and stable connection between the panels 10. The panel 10 has a central aperture 14 enclosed by a downwardly tapering sidewall 17 (FIG. 2). The sidewall 17 is provided on its outer surface with an annular protrusion 18. The height of the sidewall 17 is greater than the thickness of the panel 10 and the height of the peripheral collar 11, while the height of the annular protrusion 18 preferably equals or slightly exceeds the height of the collar 11. The central aperture 14 performs three functions: serves as a drain hole, stabilises the panel 10 on the ground and improves storage of the panels 10, laid one on another in a stack. In the last case, the lower part 19 of the sidewall 17 of the upper panel 10 enters into upper part of the central aperture 14 of the lower panel 10, while the annular protrusion 18 of the upper panel 10 rests on the top surface 15 of the lower panel 10.

Paving panel 10 may be also provided with additional, preferably smaller drain holes, cylindrical or tapered, not shown in the drawings. Instead of or in addition to the single central aperture 14 the panel 10 may be provided with two, three or more similar apertures 14, arranged symmetrically around the centre of the panel 10.

The top surface 15 of the panel 10 (FIG. 1A) has a rough anti-slip pattern, while the bottom surface 16 is provided with conical or prismatic recesses 20 with large obtuse angle $\alpha$, creating in a section a line, weavy or in the shape of a honeycomb. The recesses 20 increase the load-bearing surface and reduce the weight of the panel 10, ensuring its proper stability on the ground, even steep, loose or muddy.

Each upper tab element 12 (FIG. 3) extends beyond the collar 11 and has downwardly extending upper vertical arm 21, the upper surface of which is flush with the top surface 15 of the panel 10. The upper vertical arm 21 is rectangular in a cross-section, preferably with rounded lower corners. Between the upper vertical arm 21 and the collar 11 an upper cavity 22 is formed, open at the bottom and having a rectangular cross-section. The lower tab element 13 has upwardly extending lower vertical arm 23, the bottom surface of which is flush with the bottom surface of the collar 11. The lower vertical arm 23 is rectangular in a cross-section, preferably with rounded upper corners. Between the lower vertical arm 23 and the panel's side a lower cavity 24 is formed, open at the top and having a rectangular cross-section.

Paving panels 10 are connected during the layout on the ground in such a way that the upper vertical arm 21 of the upper tab element 12 of one panel enters into the lower vertical cavity 24 of the lower tab element 13 of adjacent panel and at the same time the lower vertical arm 23 of the lower tab element 13 enters into the upper cavity 22 of the upper tab element 12 (FIG. 3).

Dimensions of the tab elements 12 and 13 are chosen so that the leading surfaces of the vertical arms 21 and 23 contact the bottom surfaces of the cavities 24 and 22, while the width of the cavities 22 and 24 of the tab elements 12 and 13 should be preferably the same and wider than the same width of the vertical arms 21 and 23 by approximately 2 mm to 8 mm, preferably 4 mm. Due to such dimensions between the connected panels 10 remains a certain play, enabling slight mutual movement of the panels under a load.

Length of the side of the panel 10 shown as an example in the drawing is 27.5 cm or 31 cm. In the first case, the area of the panel 10 equals 0.1994 $m^2$ and in the second case 0.249 $m^2$. To cover 1 $m^2$ of the ground, taking into accounts gaps between the panels, five smaller or four larger panels 10 are needed. Preferred dimensions of individual elements of the panel 10 are as follows (FIG. 2): height h1 of the collar 11—2.5 cm; smaller thickness h2 of the panel—1 cm; greater thickness h3 of the panel—1.5 cm; width w1 of the collar 11—1.15 cm; width w2 of the conical or prismatic recess 20—7.53 cm and its obtuse angle $\alpha$—165.60° maximum diameter w3 of the central aperture 14—4.8 cm and its minimum diameter w4—3 cm; outer diameter w5 of the sidewall 17 in its lowest part—5 cm; and outer diameter w6 of the sidewall 17 in the area of connection with annular protrusion 19—7.52 cm.

Examples of preferred dimensions of the upper and lower tab elements 12 and 13 are as follows (FIGS. 1B and 3): width w of the tab elements—2.4 cm; thickness w8 of the vertical arms 21 and 23—1 cm; width w9 of cavities 22, 24—1.4 cm; height h4 of the upper vertical arm 21—1.5 cm; while the height h5 of the lower vertical arm 23—1.7 cm.

The above dimensions may, of course, be changed, depending on the type of plastics from which the panels 10 are produced, load and type of ground to be laid upon.

Figure 4B:
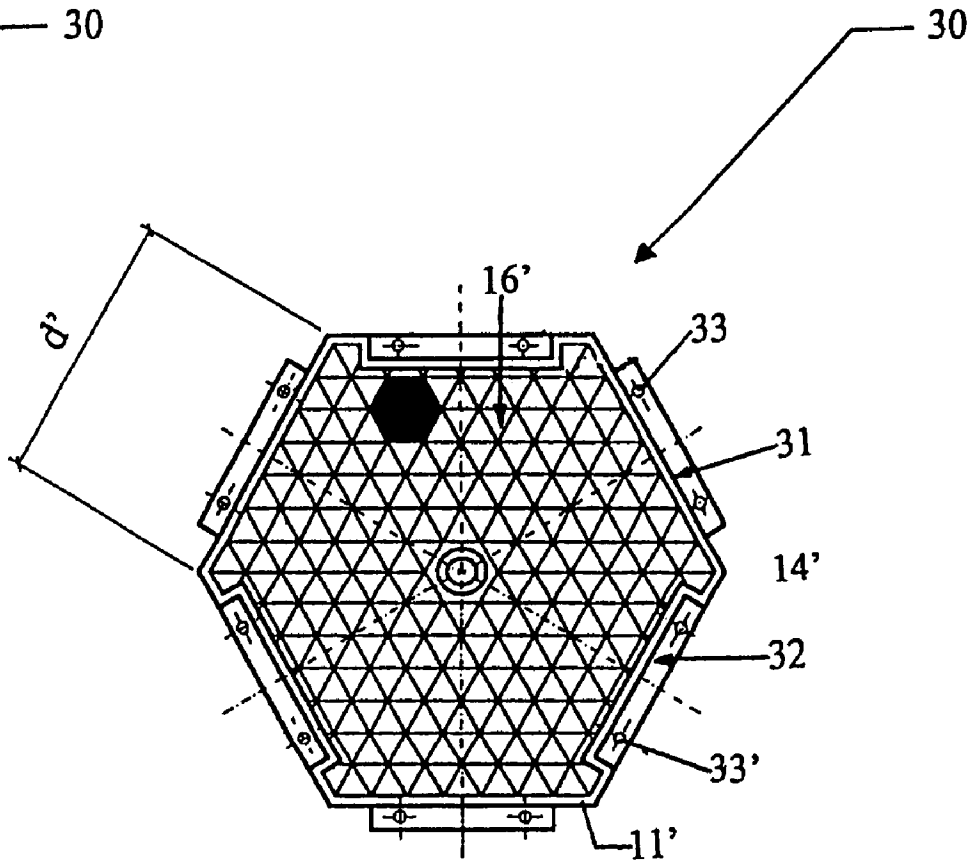
FIGS. 4A and 4B are top and bottom views, respectively, of a hexagonal plastic paving panel of the light type, comprising overlap connecting elements and fixing pins.
Figure 4A:
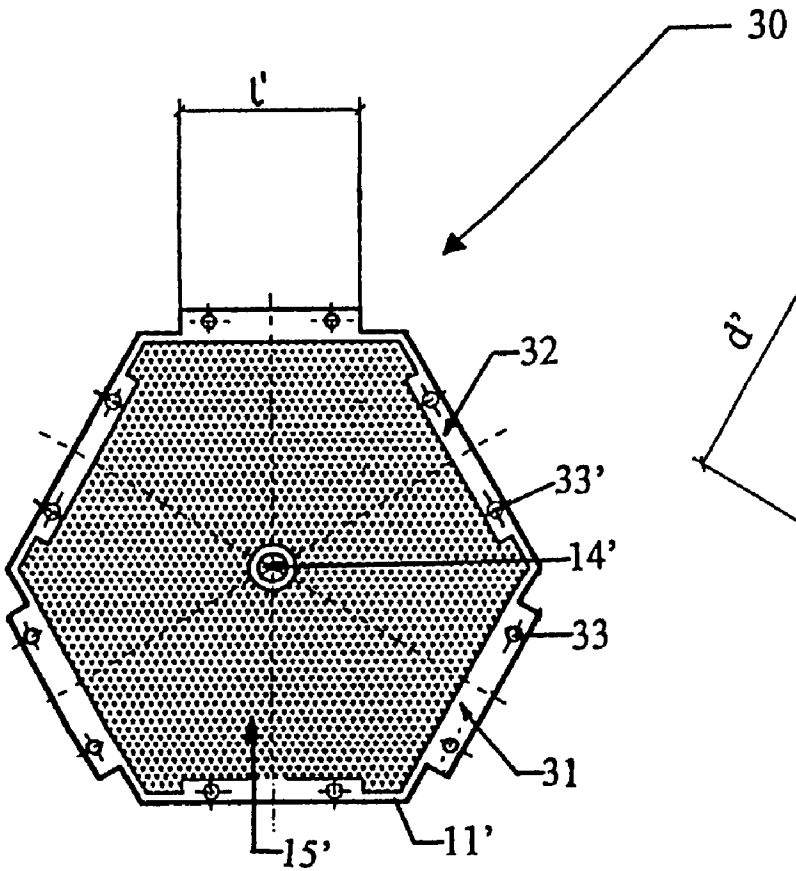
Figure 5:
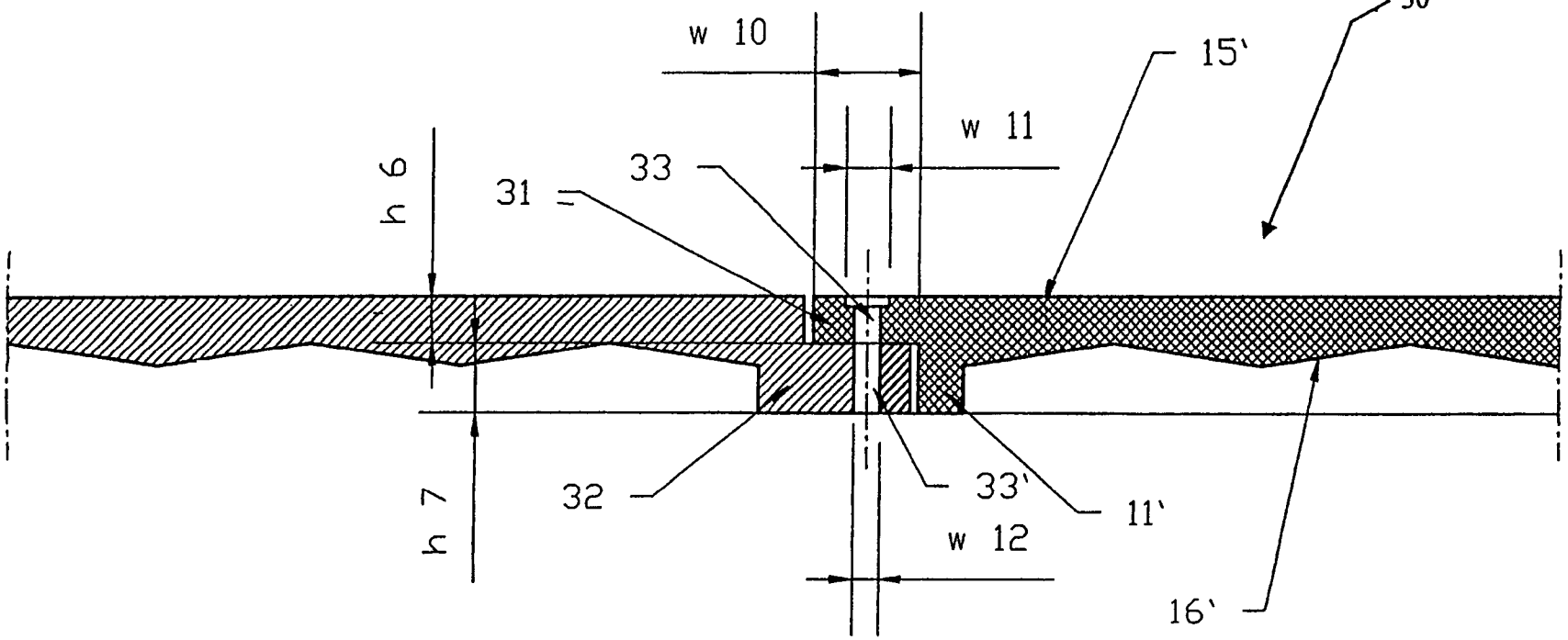
FIG. 5 is a sectional view of connection of two panels of FIGS. 4A and 4B.

FIGS. 4 and 5 show another embodiment of the invention. A hexagonal paving panel 30 is formed as a one-piece plastics moulding, particularly from waste or recycled material. The panel 30 differs from the panel 10 in being provided with, instead of hook-type connecting arrangement, an overlap-type connecting arrangement and fixing pins. All the remaining construction features of the two paving panels 10 and 30 are the same. The panel 30 has three identical upper overlap elements 31 extending beyond the collar 11', and three identical lower overlap elements 32 formed by reducing the thickness of the collar of the panel 30. Reverse arrangement, where lower overlap elements 32 extend beyond the collar 11' and upper overlap elements 31 are formed by reducing the panel thickness is also possible. The upper surface of the upper overlap element 31 is flush with the top surface 15' of the panel 30 and the lower surface of the lower overlap element 32 lies in the plane of the bottom surface of the collar 11'.

Both overlap elements 31 and 32 are substantially rectangular in a cross-section. The upper overlap element 31 has two upper fixing holes 33 countersunk in the upper part, and the lower overlap element 32 has two lower fixing holes 33', which after positioning the panels on the ground are aligned with the upper fixing holes 33 of the adjacent panel. The number of fixing holes 33 and 33' on each overlap element 31, 32 may be between one and four depending on the ground and the load.

During laying paving panels 30 on the ground (FIG. 5) the upper overlap element 31 of one panel overlies on the lower overlap element 32 of the adjacent panel, and after alignment of their fixing holes 33 and 33', between the side surface of the upper overlap element 31 of one panel and the side surface of the second panel, as well as between the side surface of the lower overlap element 32 of the second panel and side surface of the first panel's collar 11' gaps are formed in the width of 1 mm to 4 mm, preferably 2 mm. Through the aligned fixing holes 33 and 33' of the overlap elements 31 and 32 of two adjacent panels 30 extend fixing bolts or pins (described further below), preferably made of plastics, wherein the head of each fixing pin enters into the countersunk part of the upper fixing hole 33 and its tip may enter into the ground. Fixing pins secure the panels against slipping.

In the example of the panel 30 having side length d'=27.5 cm, the thickness h6 of the upper overlap element 31 equals 1 cm; the thickness h7 of the lower overlap element 32—1.5 cm; the width w10 of both overlap elements 31 and 32—2.4 cm; diameter w11 of the countersunk part of the upper fixing hole 33—1.2 cm; while the diameter w12 of the remaining part of the upper fixing hole 33 and that of the lower fixing hole 33'—0.8 cm. Remaining dimensions of this panel 30 are the same as those of the panel 10 according to FIGS. 1 to 3.

The hexagonal paving panels 10 and 30 according to the invention, as described above, are produced entirely of plastics, originated mostly in recycling.

FIGS. 6 to 9 present next two embodiments of the invention being heavy-duty hexagonal paving panels, intended primarily to cover the ground for heavy equipment, like for example contractor machines.

The shape of the connecting elements and dimensions of the panels are the same as those of panels 30 according to FIGS. 4 and 5, but the later have a skeleton construction.

Figure 6:
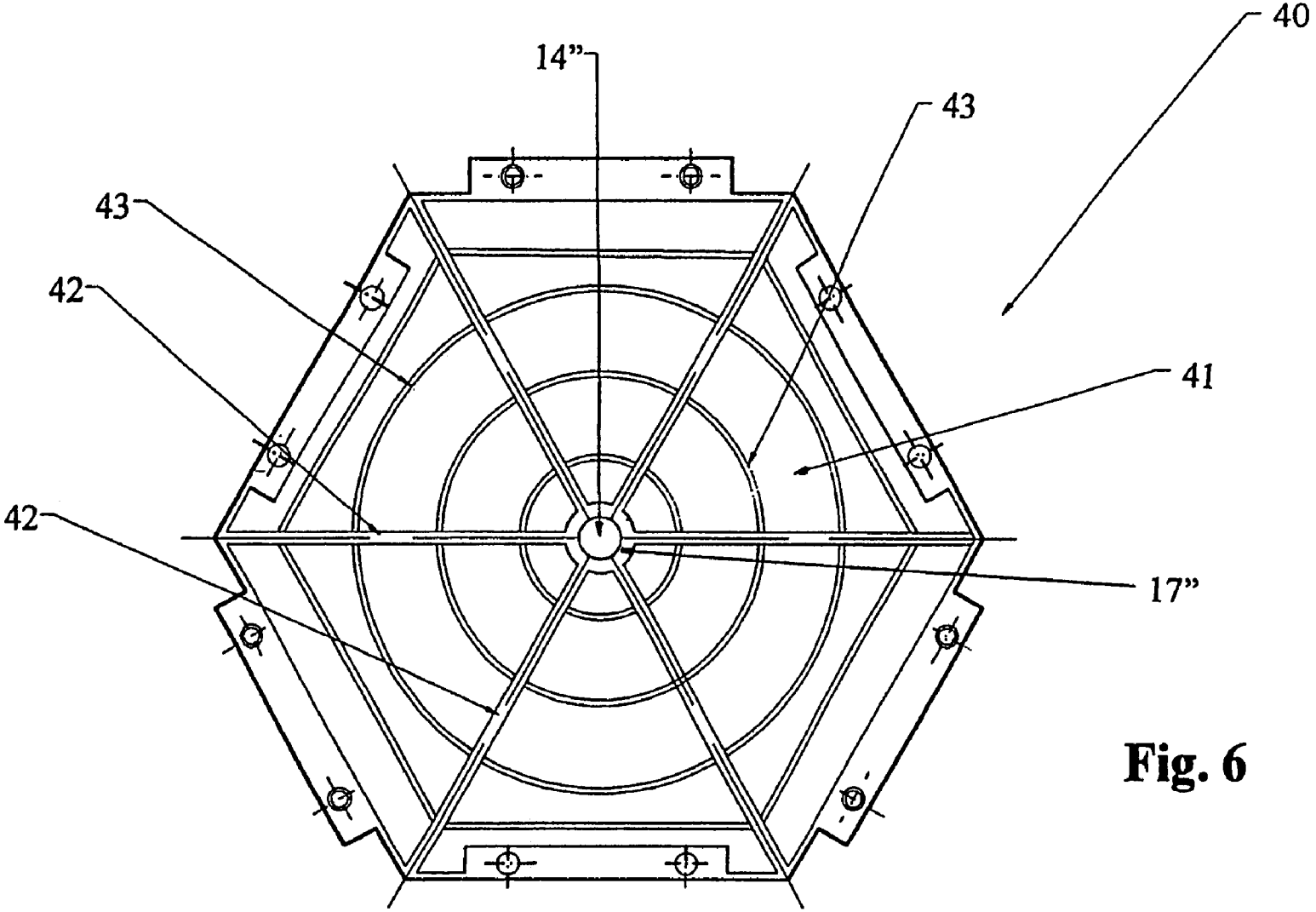
FIG. 6 is a top view of a plastic frame for a heavy-duty panel, comprising reinforcement, overlap connecting elements and fixing pins.
Figure 7:
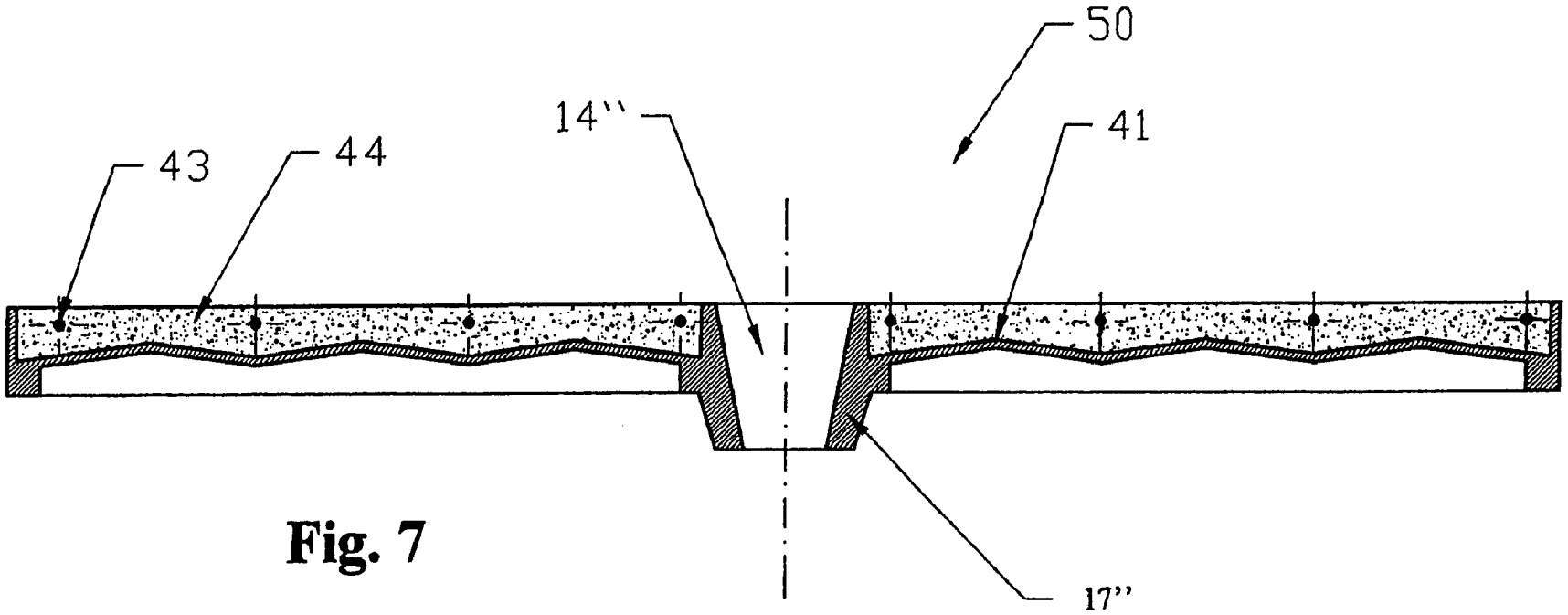
FIG. 7 is a sectional view of the panel obtained by filling the frame of FIG. 6 with rubber mass.

The skeleton 40 of the paving panel 50, presented in FIG. 6, consists of a plastic hexagonal frame 41 provided with all the elements of the connecting arrangement of the panel 30. The frame 41 features radial bracing ribs 42, connecting a sidewall 17" of a central aperture 14" with panel corners, and a reinforcement 43, comprising a few coaxial coils of steel wire of 1 to 6 mm in diameter, preferably 4 mm, which extend through holes in the radial bracing ribs 42. The skeleton 40 of the panel 50 performs at the same time a function of a form for rubber filling 44 (FIG. 7), constituting together with the filling 44 the heavy-duty paving panel 50.

Figure 8:
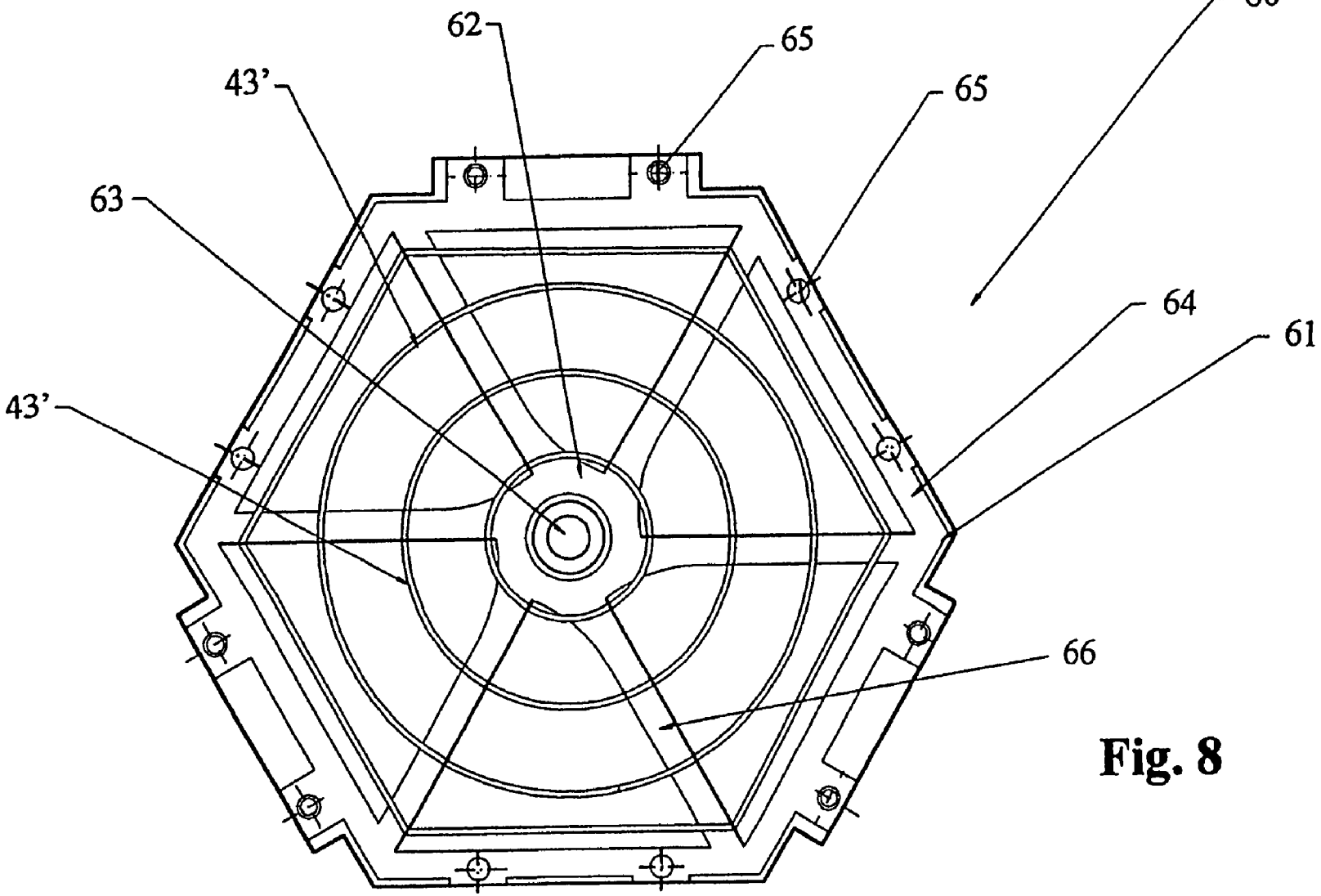
FIG. 8 is a top view of a metal frame for a heavy-duty panel, comprising reinforcement, overlap connecting elements and fixing pins.
Figure 9:
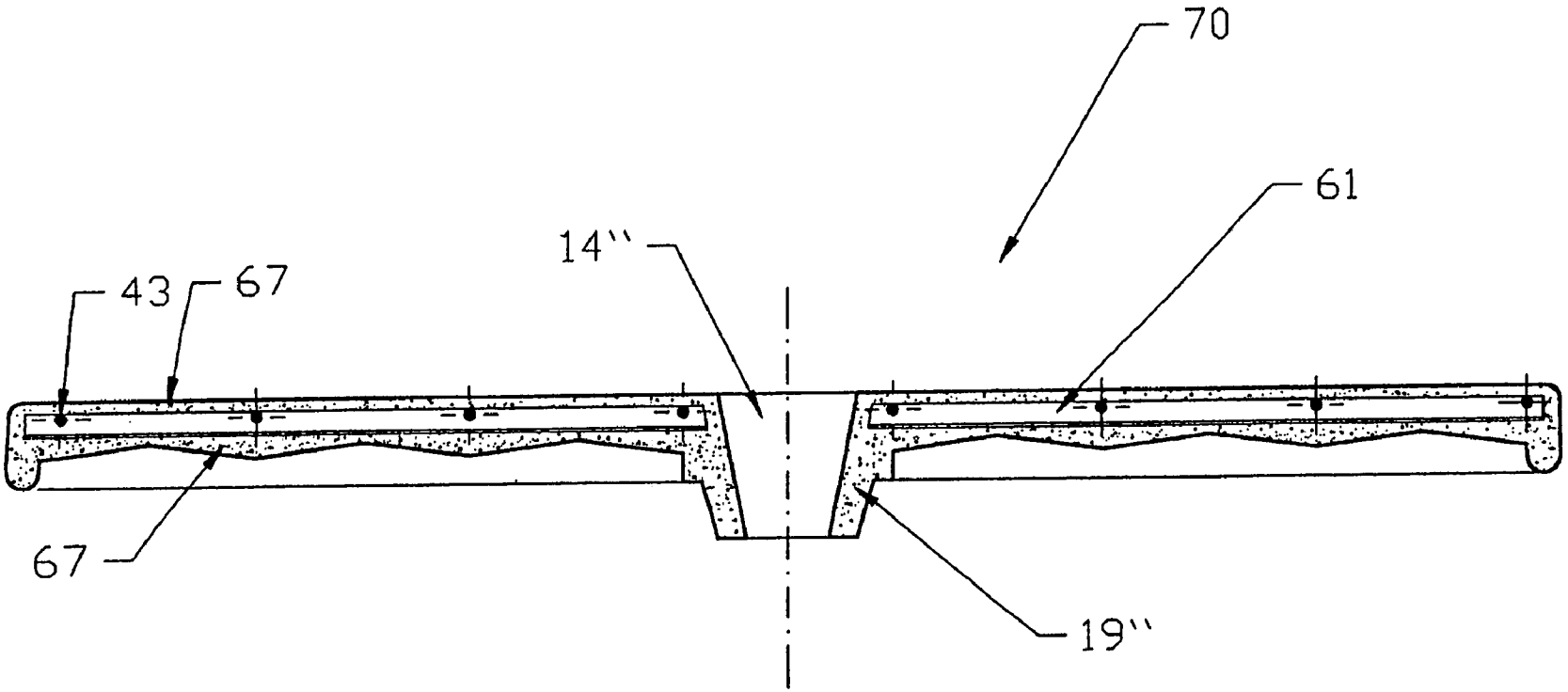
FIG. 9 is a sectional view of the panel obtained by filling the frame of FIG. 8 with rubber mass.

FIG. 8 presents further embodiment of a skeleton construction 60, which is provided with a hexagonal frame 61, produced of sheet metal, preferably steel. The frame 61 has a central part 62 with a central aperture 63, a hexagonal rim 64 with a perimeter slightly smaller than that of a paving panel 70, and provided with holes 65 and 65' in those locations where fixing holes of overlap elements of the panel 70 are formed, and radial bracing ribs 66, connecting the central part 62 with corners of the hexagonal rim 64. The skeleton 60 features also a reinforcement 43', similarly like in the case of skeleton construction 40 according to FIGS. 6 and 7.

The skeleton 60 is placed in a form (not shown), in which it is covered on both sides in a casting of rubber filling 67 (FIG. 9), resulting in a strengthened rubber paving panel 70. Due to the fact that the panel 70 has no plastic components the use of high temperature rubber casting mass as well as pressing of the mass during the casting is possible.

The rubber fillings 44 and 67 used in the two embodiments of heavy-duty paving panels 50 and 70 consists of rubber granulate, obtained preferably by grinding of worn automobile tyres and of hardening adhesive mixed with the granulate. Before casting, the rubber fillings 44 and 67 are heated up to the temperature of softening and after casting they are cooled down. The rubber paving panels 50 and 70 are relatively hard and resistant to abrasion.

Further embodiment of the invention is a hexagonal paving panel 100 comprising an overlap-type connecting arrangement with fixing pins. The panel 100 is provided with downwardly extending wide peripheral collar 101, and with integral upper and lower overlap elements 102 and 103 formed alternately on its sites. The upper overlap elements 102 are formed by decreasing the thickness of the collar 101, and the lower overlap elements 103 extend beyond the hexagonal outline of the panel 100. Reverse arrangement of the overlap elements 102 and 103 is also possible.

The upper surface of the upper overlap element 102 is flush with the top surface 104 of the panel 100, while the bottom surface of the lower overlap element 103 lies in the plane of lower surface of the collar 101. Construction of the overlap connecting elements of the panel 100 differs from the panels 10 and 30 in this way that the upper overlap elements 102 are provided with additional upper connecting holes 105, preferably oval, while in the lower overlap elements 103 are provided with correspondingly shaped upright connecting protrusions 106, which enter into the connecting holes 105 of the upper overlap element 102 of the adjacent panel 100. Due to this the number of fixing holes 107 and 108 and fixing pins in the overlap connecting elements has been reduced.

In the preferred embodiment of the invention two connecting holes 105 and thus two connecting protrusions 106 are formed and between the two connecting holes 105 and connecting protrusions 106 one fixing hole 107 and 108 for the fixing pin is formed. Construction of the fixing holes 107 and of the fixing pins will be described in detail further below. Such modification of the overlap connecting elements permits the road surface made of the panels 100 to carry considerably higher loads.

Figure 11:
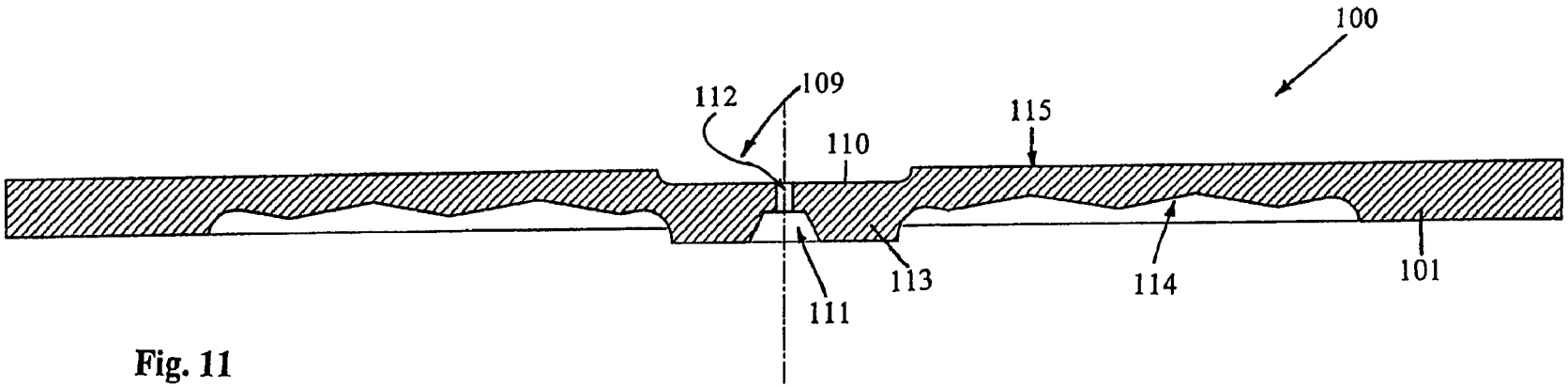
FIG. 11 is a sectional view of the panel taken on the line A-A of FIG. 10A.
Figure 12:
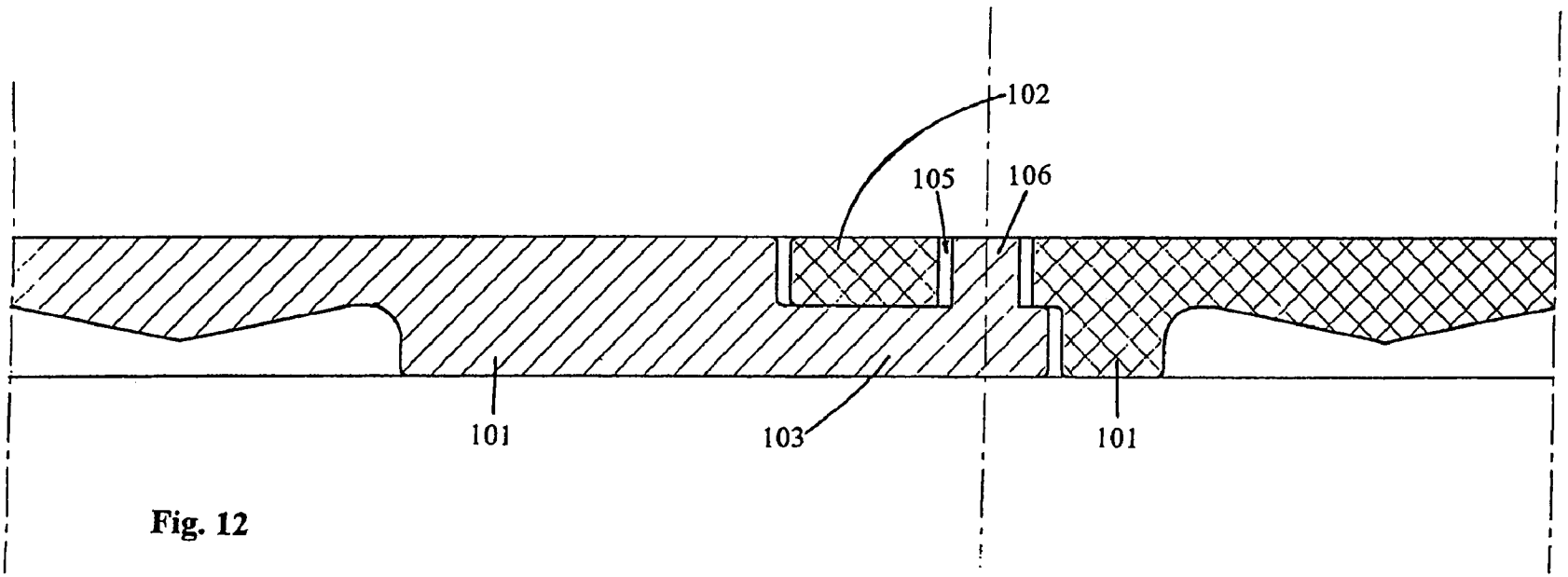
FIG. 12 is a sectional view of the panel taken on the line B-B of FIG. 10A.

Also the construction of the central aperture 110 is accordingly modified (FIG. 11). The central aperture 110 has in the top a shallow planar recess 110 and in the bottom a narrower frustoconical recess 111, the two being connected by a narrow channel 112. Thickness of the sidewall 113 of the central aperture 109 is considerably bigger, as a result the protruding ring became eliminated. The sidewall 113 extends beyond the bottom surface of the collar 101 of the panel 100. Outer diameter of the sidewall 113 is approximately the same as that of the planar recess 110 of the central aperture 109. Such shape of central aperture 109 permits the storage of the panels 100 in a stack without a risk of lateral displacement.

On the surface of the planar recess 110 may be located manufacturer's name or other markings. The panel 100 has a fragment of the surface, preferably on the upper overlap element 102 intended for applying an identification number, individual for each panel, to enable controlling the panels' distribution and to facilitate identification of stolen panels.

In this embodiment according to the invention, transitions between the sidewall 113 of central aperture 109 and the bottom surface 114, and between the collar 101 and the bottom surface 114, are rounded.

Figure 10A:
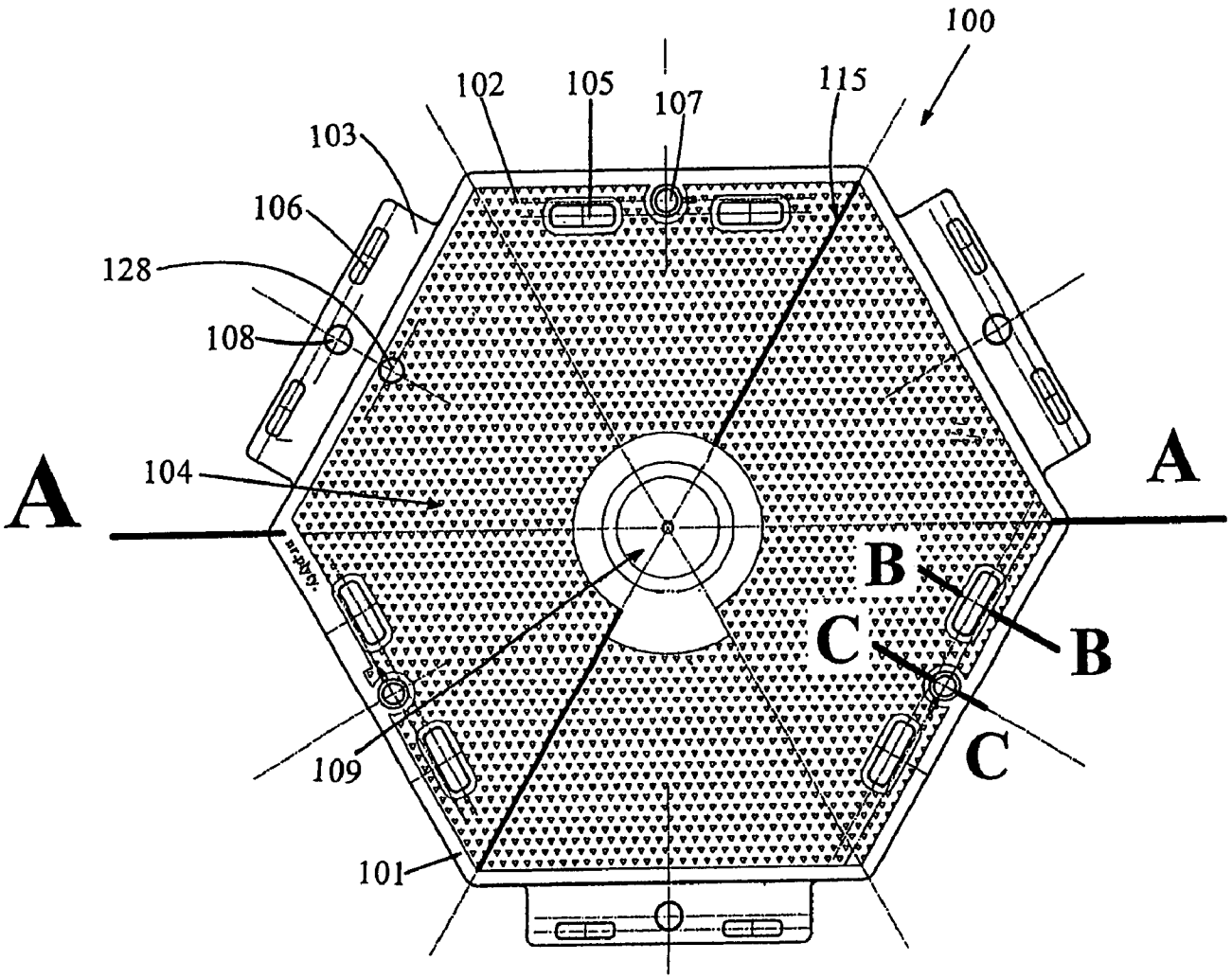
FIGS. 10A and 10B are top and bottom views, respectively, of another hexagonal plastic paving panel of the light type, comprising overlap connecting elements and fixing pins.
Figure 10B:
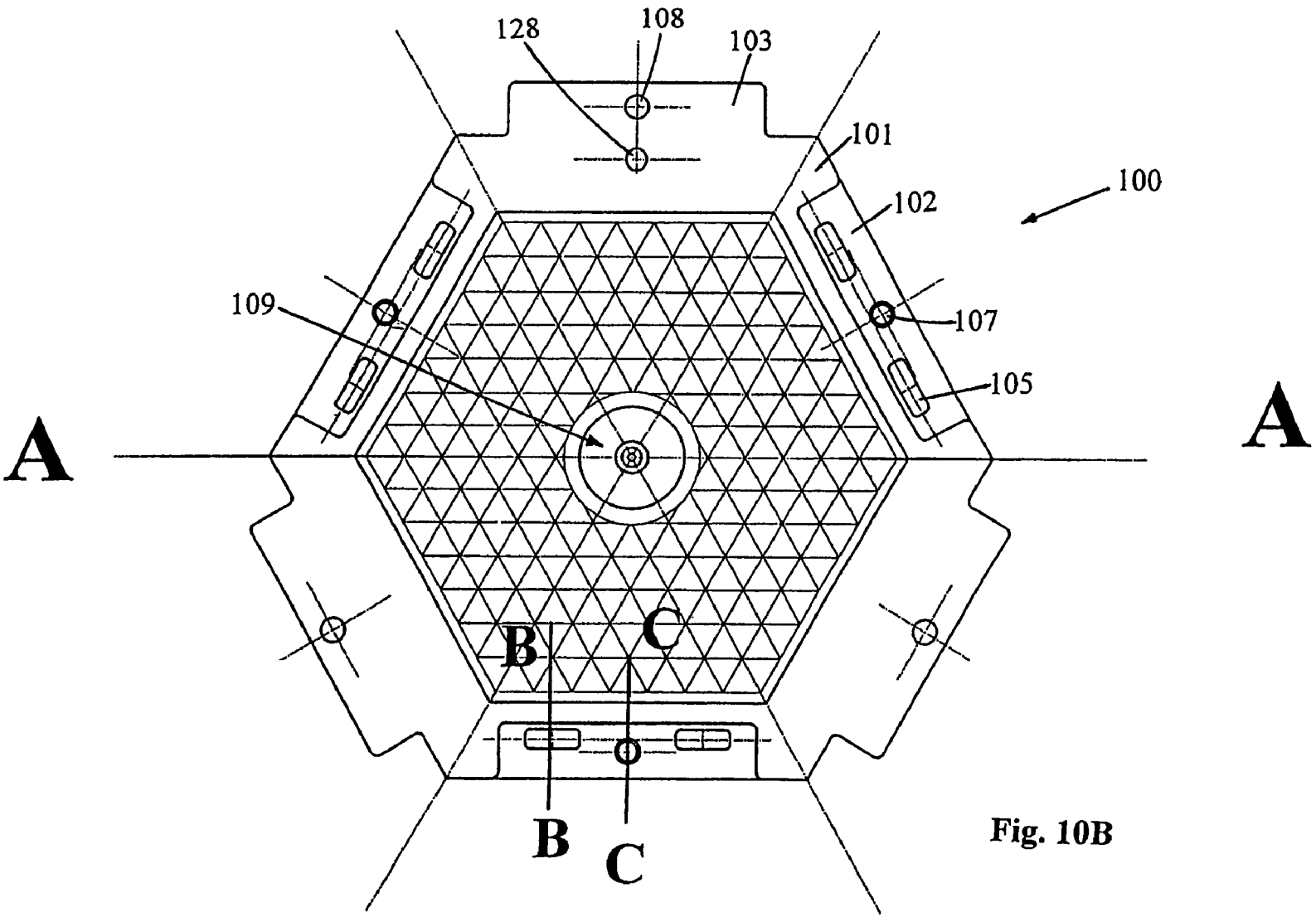
Figure 10C:
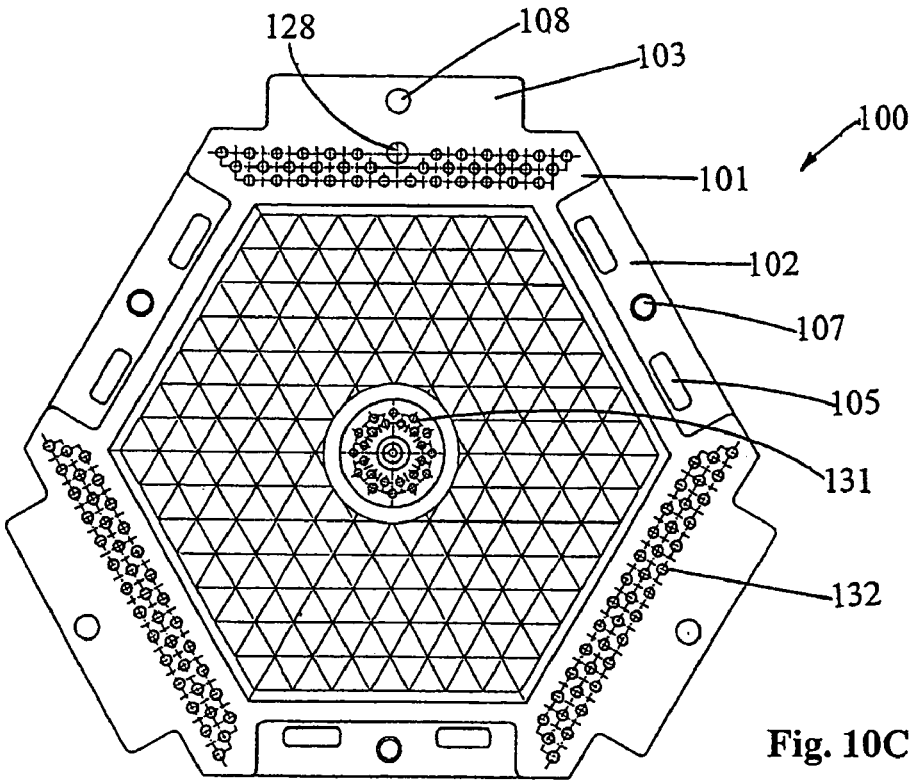
FIGS. 10C and 10D are bottom views of the panel of FIG. 10B with arrangements of openings.
Figure 10D:
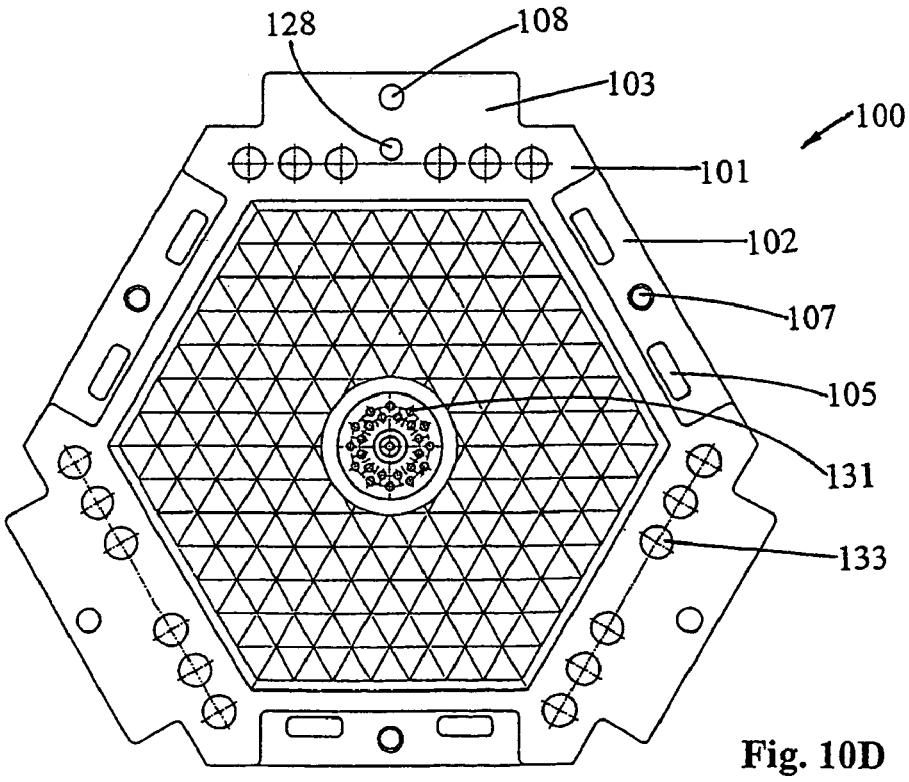

The paving panel 100 is provided also with a well visible marker 115 for easier dividing of the panel into two parts. The marker 115 may have any practical form, for example that of a shallow linear groove. The paving panel 100 (FIG. 10C) may be provided on its bottom side with an inner arrangement of blind openings 131, formed on the sidewall 113 of the central aperture 109 and/or with an outer arrangement of blind openings 132, formed on these parts of the collar 101 from which the lower overlap elements 103 extend. Instead of the arrangement of large number of small blind openings 132 may be formed an arrangement of lesser number of larger blind openings 133 (FIG. 10D). The blind openings 131, 132 and 133, which may have any practical shape, are intended to reduce the weight of panel 100 and to accelerate its drying after the forming process.

Figure 13A:
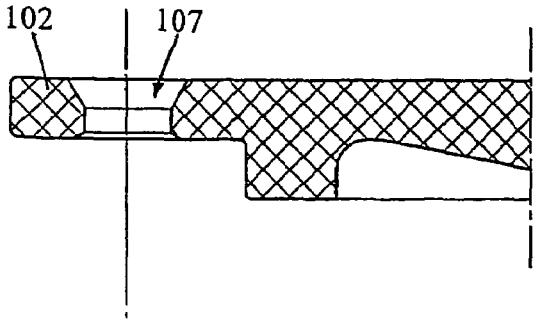
FIG. 13A is a sectional view of the panel taken on the line C-C of FIG. 10A.
Figure 13B:
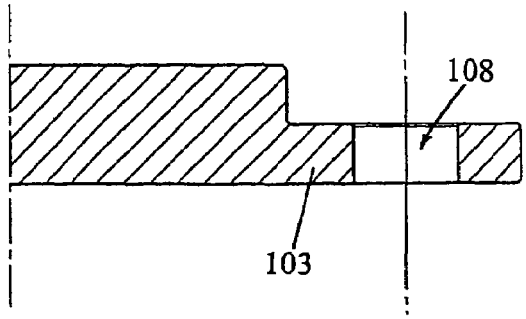
FIG. 13B is a sectional view of the panel taken on the line D-D of FIG. 10A.
Figure 14A:
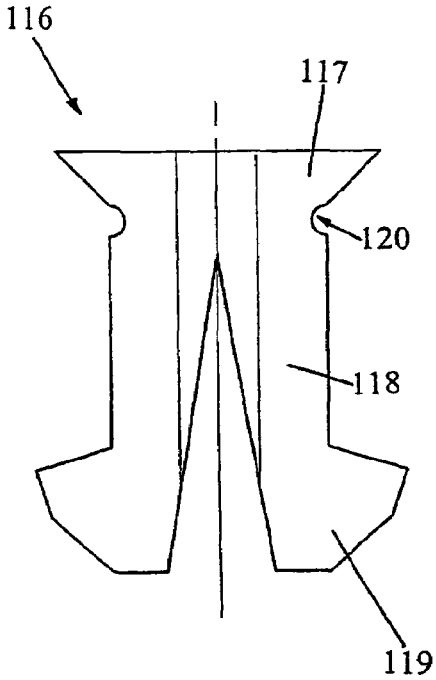
FIG. 14A is a side view of a fixing pin for connecting panels of FIGS. 10A to 10D.
Figure 15:
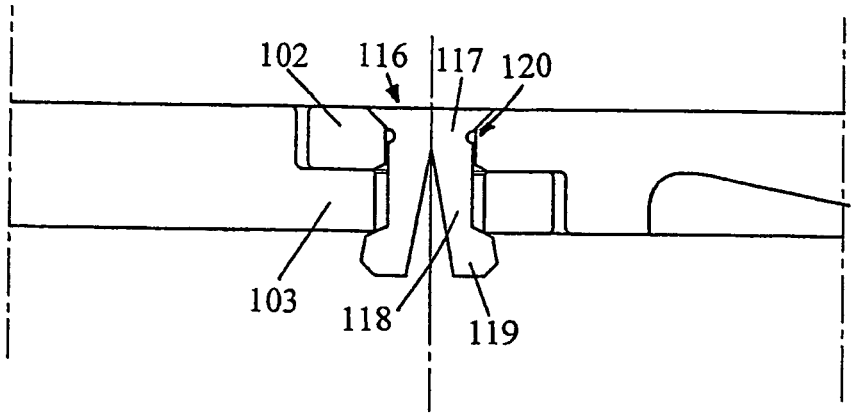
FIG. 15 is a side view of connection of two panels of FIGS. 10A to 10D.

FIGS. 13A and 13B present upper and lower overlap elements 102 and 103 in section through upper and lower fixing holes for the fixing pin. Upper fixing hole 107 is conically countersunk at top and bottom parts, while the lower fixing hole 108 is cylindrical, with diameter slightly larger then that of the middle part of the upper fixing hole 107. For such shape of the fixing holes 107 and 108 a special fixing clip-pin 116 has been developed (FIGS. 14A and 15), the top surface of which is flush with the top surface 104 of the panel 100.

Figure 16:
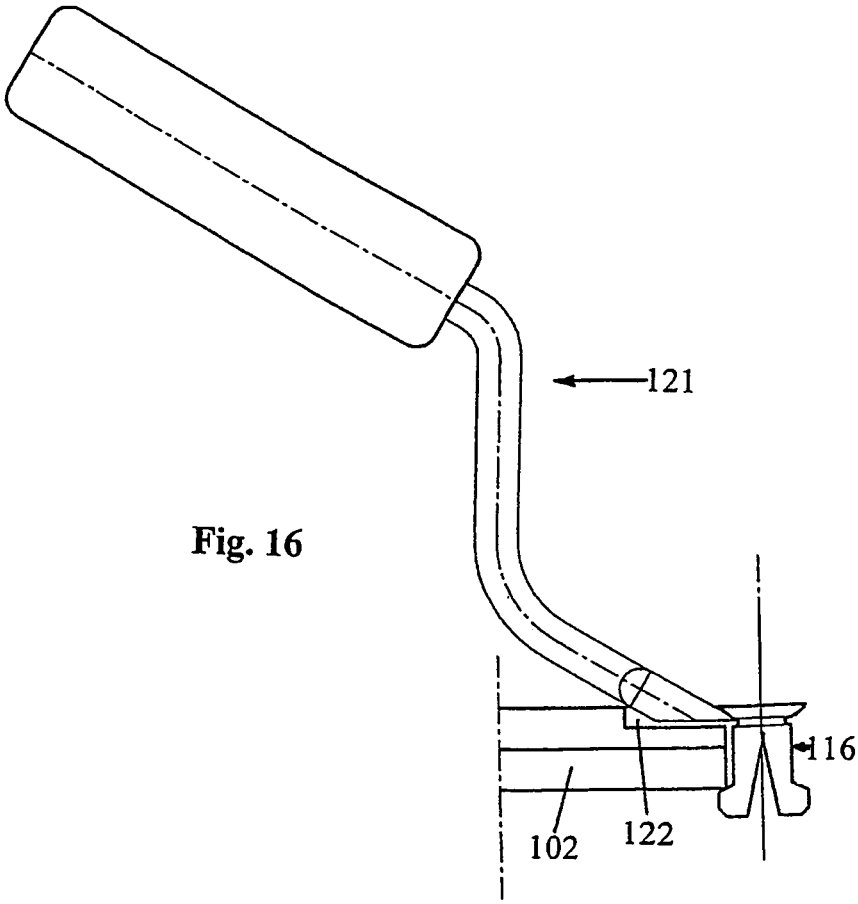
FIG. 16 is a side view of a disassembly tool for removing fixing pins from fixing holes in panels.

The clip-pin 116 has a conical head 117 which fits into the countersink part of the fixing hole 107 of the upper overlap element 102 and four resilient legs 118 extending from the head 117 and ended with specially shaped tips 119, which after connecting the panels 100 engage with lower edge of the fixing hole 108. The number of resilient legs 118 may be from two to six, preferably four. The clip-pin 116 is provided near the head 117 with a circumferential groove 120 into which enters a flat tip of disassembly tool 121, specially constructed for this purpose (FIG. 16). The disassembly tool 121 has a form of a bent rod with a handle ended with the flat tip.

To provide an access to the circumferential groove 120 of the clip-pin 116, the upper fixing hole 107 has in its side a narrow slot 122 (FIGS. 10 and 16) into which may enter the flat tip of the disassembly tool 121. Between the clip-pin 116 and the inner surface of the fixing holes 107 and 108 is created a certain play to allow some displacement of the connected panels 100 under load, or as an effect of temperature changes. Construction of the fixing holes 107 and 108 to connect panels 100 with the clip-pins 116 as well as the special design of the clip-pins 116 and the disassembly tool 121 enable easy and strong connection of adjacent panels, disconnection of which is not possible without use of a tool.

Figure 17:
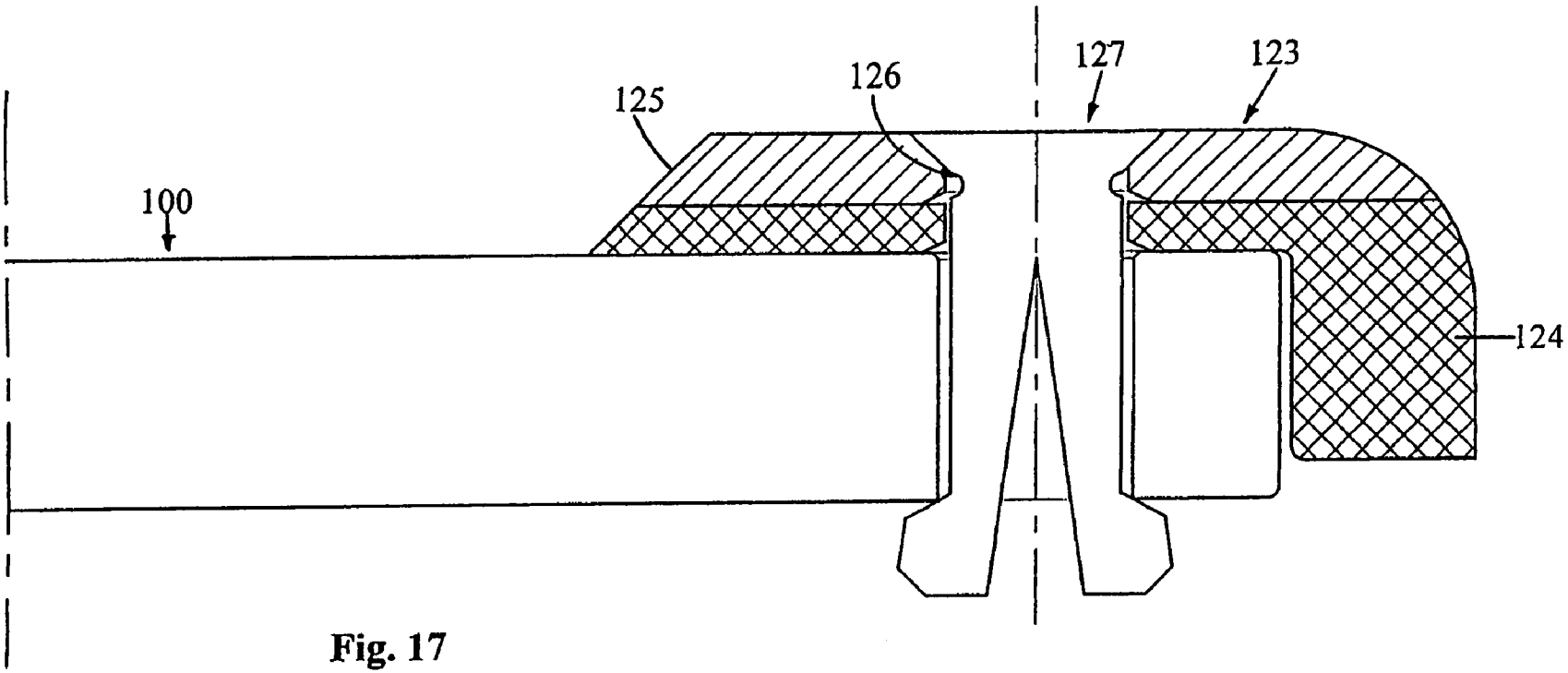
FIG. 17 is a partial sectional view of the finishing strip connected to the panel.

For finishing the edge of road surface made of the panels 100 according to the invention a finishing strip 123 has been developed (FIG. 17), the strip having on its oblong side a vertical wall 124 with a rounded edge and a chamfered opposite elongated side 125, constituting a gentle transition between the top surface 104 of the panel 100 and the top surface of the strip 123. The finishing strip 123 is provided with fixing holes 126 arranged over its length, and which, after positioning of the strip on the edge of the road surface constructed, become aligned with additional fixing holes 128, located near the lower overlap elements 103 (FIGS. 10 and 11) of panels. Through these fixing holes 126 and 128 extend fixing pins 127 according to the invention, similar to the clip-pins 116 connecting the panels 100, but longer.

Figure 14B:
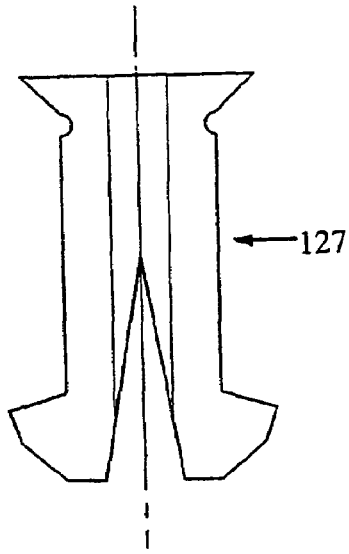
FIG. 14B is a side view of a fixing pin for connecting a finishing strip to the panels of FIGS. 10A to 10D.
Figure 18:
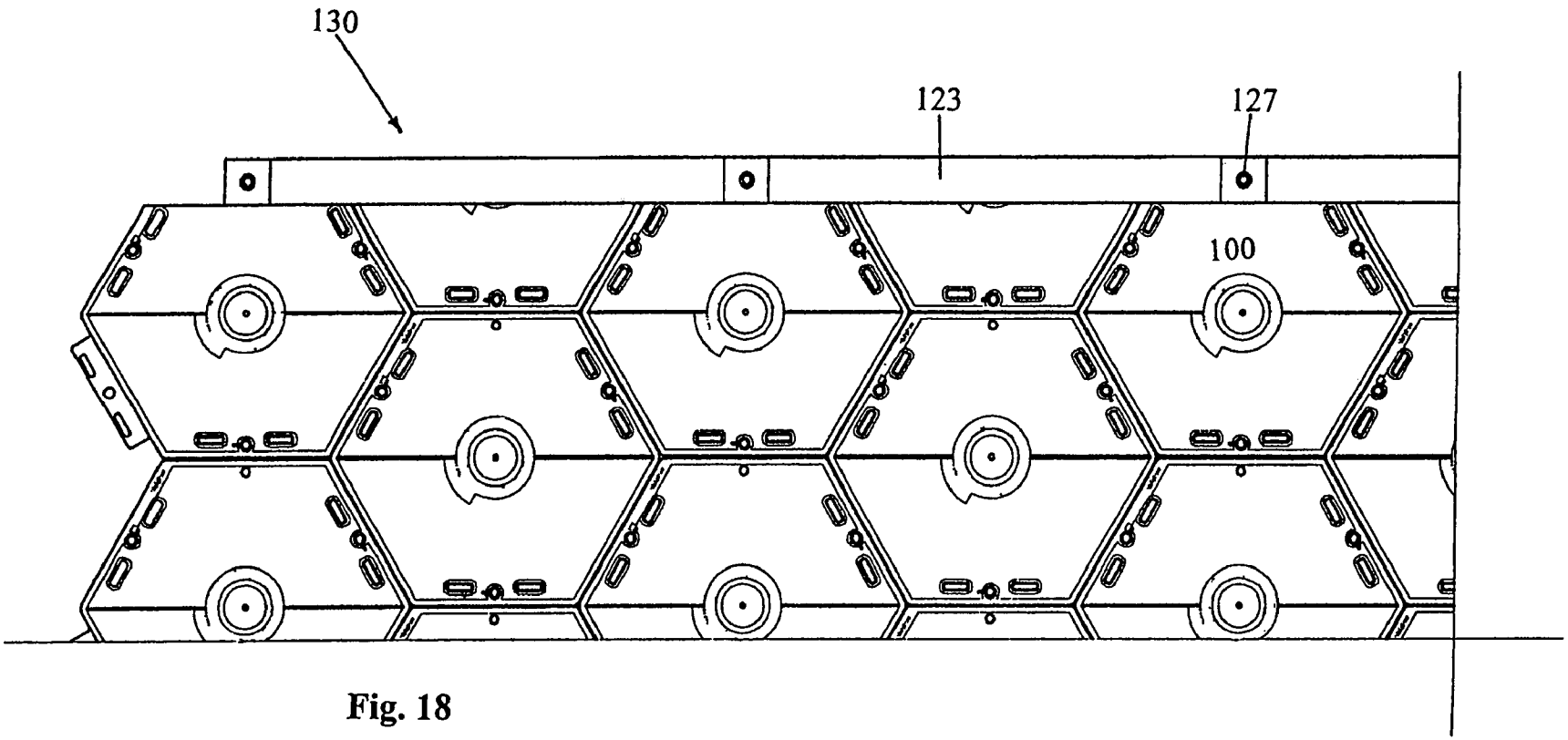
FIG. 18 is a plan view of a portion of a road surface made of the hexagonal paving panels according to the invention.

FIG. 18 shows a portion of ready road surface 130 laid-out of the panels 100 according to the invention. Free spaces on the road surface 130 constructed have been filled with halves of panels 100 cut-up along the marker 115. The road surface 130 is finished at the sides with finishing strips 123, fitted with the clip-pins 127, as shown in FIG. 14B. Special construction of the panels 100, produced entirely of plastics, particularly the construction of connecting elements and of fixing pins permit transmission by the road surface 130 of high loads, without any damage of individual panels.

The plastic used for production of the paving panels 10, 30 and 100 according to the invention may be obtained entirely as waste or recycled material. Besides, worn panels may be submitted to recycling. This feature of the invention is extremely important for the environment protection, since waste plastics, the presence of which becomes a growing environmental problem, due to their long decomposition time and content of toxic substances, may be in this way utilised.

The preferred plastic material for panels 10, 30 and 100, finishing strips 123, clip-pins 116 and 127 is in the combination of polyethylene (PE) and polypropylene (PP), commonly present as waste. In order to select the best composition of these components and possible modifying agents, several tests were conducted as to the strength and deformation of materials produced from various combinations of the components.

To the strength tests were submitted samples of materials with varying content of PE, PP and chalk (K). The tests were conducted on an INSTRON machine at three temperatures: two extremes (−30° C. and +60° C.) and one room temperature (+20° C.). The tests permitted determining of elongation, strength and Young's module (E) of the materials studied. Results obtained are presented in the table below. Percentage content of the modifying agent is related to a total mass of PP and PE (100%=PP+PE).

| Temperature | Elongation [%] | | $R_m$ [Mpa] | | E [MPa] | |
|---|---|---|---|---|---|---|
| [° C.] | average | Range | Average | Range | average | range |
| | | | 100% PP + 0% PE | | | |
| 20 | 240 | | 31.9 | 31.3-32.2 | 1738 | 1608-1826 |
| 60 | 300 | | 21.5 | 21.4-21.6 | 935 | 866-1120 |
| −30 | 1 | | 49.1 | 48.0-50.1 | 3710 | 3275-4127 |
| | | | 0% PP + 100% PE | | | |
| 20 | 70 | | 18.6 | 18.5-18.8 | 355 | 280-437 |
| 60 | 150 | | 14.9 | 14.5-15.7 | 148 | 130-188 |
| −30 | 240 | | 21.8 | 21-22.2 | 1013 | 1000-1112 |
| | | | 50% PP + 50% PE | | | |
| 20 | 9 | 0.2-17 | 27.0 | 22-28 | 1630 | 1300-1900 |
| 60 | 300 | 240-350 | 18.8 | 17-20 | 780 | 678-858 |
| −30 | 2 | 1-3 | 31 | 30.1-31.6 | 3000 | 2800-3580 |
| | | | 25% PP + 75% PE | | | |
| 20 | 6 | 2.2-11.2 | 14.6 | 14.5-14.7 | 690 | 620-765 |
| 60 | 80 | 1-173 | 8.9 | 7.3-9.6 | 308 | 266-351 |
| −30 | | | 17.9 | 17.7-18.1 | 1790 | 1680-1720 |
| | | | 50% PP + 50% PE + 20% K | | | |
| 20 | 230 | | 17.3 | 17.1-17.5 | 1102 | 1012-1179 |
| 60 | 300 | | 12.1 | 11.9-12.3 | 547 | 509-643 |
| −30 | 28 | | 29.3 | 27−30.9 | 2600 | 2390-2905 |
| | | | 50% PP + 50% PE + 40% K | | | |
| 20 | 300 | | 14.65 | 14-15.3 | 1254 | 1259-1271 |
| 60 | 350 | | 11.2 | 11.1-11.3 | 568 | 498-654 |
| −30 | 26 | | 27.9 | 26-29.3 | 2863 | 2400-3494 |
| | | | 75% PP + 25% PE + 20% K | | | |
| 20 | 300 | | 17.2 | 15.2-18.8 | 1384 | 1192-1595 |
| 60 | 400 | | 12.7 | 12.0-13.3 | 658 | 534-776 |
| −30 | 10 | | 33.2 | 30.8-36.2 | 3860 | 3353-4398 |
| | | | 25% PP + 75% PE + 20% K | | | |
| 20 | 130 | | 14.8 | 14.7-14.9 | 724 | 652-805 |
| 60 | 200 | | 11.8 | 11.6-11.9 | 290 | 250-358 |
| −30 | 80 | | 22.9 | 21.4-24.5 | 1687 | 1526-1817 |

From the tests it results that the materials containing PP, PE and PP+PE combination feature relatively high mechanical strength but also relatively small deformability (elongation). Modifying the plastics with chalk results in a decrease of strength, but also in a considerable increase of deformability, important with large loads. Generally, all materials tested are suitable for the production of paving panels according to the invention and the panels manufactured may transmit high and even very high loads, originating from heavy vehicles, like delivery vans.

Most suitable material for high loads, or when the ground is not uniform, or when extensive changes of temperature are expected is in the 1:1 proportion of PP and PE with 20% addition of chalk. Instead of chalk, other modifying agents may be used, particularly talc and glass fibres in proportion ranging from 5% to 60% in relation to the total mass of PP and PE.

Besides the preferred mechanical properties, the materials tested show high resistance to acids, bases, salts and organic solvents.

Hexagonal paving panels according to the invention find application in construction of provisional temporary or permanent coverings for the places of fairs, expositions, concerts and other, building sites and access roads, pedestrian and bicycle gangways, in particular pedestrian and vehicle access to houses in newly built settlements and other objects, also roads and yards for motor vehicles and heavy equipment.

The invention claimed is:

1. A hexagonal paving panel comprising sides which are alternately provided with upper and lower connecting elements, such that after connection of the panels, lower and upper connecting elements of one panel mate with the upper and lower connecting elements of adjacent panels, the panel having a central aperture, a downwardly extending collar on the panel periphery, and a lower surface provided with a plurality of conical or prismatic recesses having a small depth and a large obtuse angle measuring about 160° to 170°;

wherein the connecting elements of the paving panel comprise upper or lower overlap elements alternately protruding from the sides beyond the peripheral collar and lower or upper overlap elements defined by reduction of thickness of the collar of the panel side, and wherein each overlap element is provided with at least one fixing hole for a fixing pin.

2. A panel according to claim 1, wherein each upper overlap element includes at least one connecting hole and each lower overlap element includes correspondingly shaped upright connecting protrusions adapted to enter into connecting holes of the upper overlap element of the adjacent panel.

3. A panel according to claim 2, wherein each upper overlap element includes two connecting holes and each lower overlap element includes two connecting protrusions, wherein between the two connecting holes and between the two connecting protrusions is located one upper and lower fixing hole, respectively, for the fixing pin.

4. A panel according to claim 3, wherein the upper fixing hole is shaped such that it extends conically in its upper and bottom parts, while the lower fixing hole is cylindrical, with a diameter slightly smaller than a maximum diameter of the upper fixing hole.

5. A panel according to claim 3, wherein the panel is provided with a fixing pin in the form of a clip-pin comprising a conical head fitting into the upper part of the upper fixing hole and resilient legs protruding from the head and ended with specially shaped tips which, after connecting the panels, extend through the lower fixing hole of the adjacent panel and rest on the lower surface of the fixing hole.

6. A panel according to claim 5, wherein the clip-pin comprises from two to six resilient legs.

7. A panel according to claim 5, wherein the clip-pin includes a circumferential groove near the head.

8. A panel according to claim 7, further comprising a disassembly tool in the form of a bent rod with a handle and a flat tip entering into a narrow slot formed at the side of the upper fixing hole and in the circumferential groove on the clip-pin.

9. A panel according to claim 2, further comprising a finishing strip, placed on the border of connected panels, wherein in the fixing holes of the strip and the additional fixing holes of the panels, located close to the lower overlap element, is settled a clip-pin.

10. A panel according to claim 9, wherein the finishing strip has, on its oblong side, a vertical wall with a rounded corner, which enters onto the border of the panel, and a chamfered opposite oblong side which constitutes a gentle passage between the upper surface of the panel and the upper surface of the strip.

11. A panel according to claim 1, wherein the central aperture includes a top part with a shallow flat recess and a bottom part with a narrower frustoconical recess, connected with the flat recess by a narrow channel.

12. A panel according to claim 11, wherein an outer diameter of a sidewall of the central aperture is approximately the same as a diameter of the flat recess.

13. A panel according to claim 12, further comprising rounded transitions between the sidewall of the central aperture and the bottom surface of the panel, and between the peripheral collar and the bottom surface of the panel.

14. A panel according to claim 12, further comprising a bottom having at least one arrangement of blind openings, provided on the sidewall of the central aperture or on parts of the collar from which the lower overlap elements extend.

15. A panel according to claim 1, wherein each overlap element has two fixing holes for fixing pins.

16. A panel according to claim 1, wherein the panel comprises a hexagonal frame produced of plastics and provided with radial bracing ribs, connecting a sidewall of a central aperture with corners of the frame, a reinforcement including a few coaxial steel wire coils extending through the holes in the bracing ribs, and a rubber filling.

17. A panel according to claim 1, wherein the panel comprises a hexagonal frame, made of sheetmetal provided with a central part, with hexagonal rim the outline of which is slightly smaller than that of a finished paving panel, and with radial bracing ribs, connecting the central part with corners of the hexagonal rim, a reinforcement, including a few coaxial steel wire coils extending through holes in the bracing ribs, and of a rubber filling, enveloping the frame of all sides and including all the constructional elements of the paving panel.

18. A panel according to claim 16, wherein the rubber filing comprises a rubber granulate, obtained by grinding worn automobile tyres, mixed with hardening adhesive.

19. A panel according to claim 1, wherein the upper surface of each upper overlap element is flush with the top surface of the panel, while the lower surface of the lower overlap element lies in the plane of the bottom surface of the collar.

20. A panel according to claim 1, wherein all of its elements are made of plastics, which includes 25% to 75% by weight of polypropylene and 75% to 25% by weight of polyethylene.

21. A panel according to claim 20, wherein the panel contains a modifying agent in the quantity of 5% to 60% by weight in relation to the total mass of polypropylene and polyethylene.

22. A panel according to claim 21, wherein the modifying agent is selected from the group consisting of chalk, talc and glass fibres.

23. A panel according to claim 20, wherein the panel is made of polypropylene in the quantity of about 50% by weight, of polyethylene in the quantity of about 50% by weight, and of chalk in the quantity of 20% by weight, in relation to the total mass of polypropylene and polyethylene.

24. A panel according to claim 1, further comprising a visible marker comprising a shallow groove extending between opposite corners of the panel.

25. A panel according to claim 1, further comprising an identification number on its top surface.

26. A hexagonal paving panel comprising sides which are alternately provided with upper and lower connecting elements, where after connection of a plurality of panels, lower and upper connecting elements of one panel mate with upper and lower connecting elements of adjacent panels, the panel being provided with a central aperture and with a downwardly extending collar on its periphery, wherein the upper and lower connecting elements of the paving panel respectively comprise upper and lower tab elements alternately protruding from the peripheral collar, the upper tab elements having a downwardly extending upper vertical arm, and the lower tab elements having an upwardly extending lower vertical arm, wherein after connection of adjacent panels between the upper vertical arm and the peripheral collar is formed an upper cavity open from the bottom, and between the lower vertical arm and the side of the panel is formed a lower cavity open from the top, the cavities and vertical arms being approximately rectangular in a cross-section.

27. A panel according to claim 26, wherein the central aperture has a frustoconical shape, narrower in a lower part, and has a sidewall with an annular protrusion on an outer surface.

28. A panel according to claim 27, wherein a lower surface of the annular protrusion lies in a plane of a lower surface of the collar.

29. A panel according to claim 26, wherein the tab elements have cavities with a width and vertical arms with a thickness that is approximately 70% of the width of the cavities of the tab elements.

30. A panel according to claim 26, wherein a height of the upper vertical arm of the upper tab element is equal to or slightly less than a depth of the lower cavity of the lower tab element, and a height of the lower vertical arm of the lower tab element is equal to or slightly less than a depth of the upper cavity of the upper tab element.

31. A panel according to claim 26, wherein the sidewall of the central aperture extends beyond a lower surface of the collar of the paving panel.

32. A panel according to claim 26, wherein a lower surface of the paving panel is provided with recesses having a small depth and a large obtuse angle.

33. A panel according to claim 32, wherein a ratio between a greatest thickness and a smallest thickness of the panel equals approximately 1.5.

34. A panel according to claim 26, wherein a length of the tab elements measures between 50% and 80% of a length of the panel's side.

35. A panel according to claim 26, wherein all of its elements are made of plastics, which includes 25% to 75% by weight of polypropylene and 75% to 25% by weight of polyethylene.

36. A panel according to claim 35, wherein the panel contains a modifying agent in the quantity of 5% to 60% by weight in relation to the total mass of polypropylene and polyethylene.

37. A panel according to claim 36, wherein the modifying agent is selected from the group consisting of chalk, talc and glass fibres.

38. A panel according to claim 36, wherein the panel is made of polypropylene in the quantity of about 50% by weight, of polyethylene in the quantity of about 50% by weight, and of chalk in the quantity of 20% by weight, in relation to the total mass of polypropylene and polyethylene.

39. A panel according to claim 26, further comprising a visible marker comprising a shallow groove extending between opposite corners of the panel.

40. A panel according to claim 26, further comprising an identification number on its top surface.

* * * * *

UNITED STATES PATENT AND TRADEMARK OFFICE

CERTIFICATE OF CORRECTION

PATENT NO. : 7,331,147 B2
APPLICATION NO. : 10/489540
DATED : February 19, 2008
INVENTOR(S) : Jerzy Kalisiak et al.

It is certified that error appears in the above-identified patent and that said Letters Patent is hereby corrected as shown below:

On the Title Page

Item (73), delete "Warzawa" and substitute --Warszawa-- in its place.

Column 13, in claim 18, line 2, before "comprises a rubber" delete "filing" and substitute --filling-- in its place.

Signed and Sealed this

Nineteenth Day of August, 2008

JON W. DUDAS
*Director of the United States Patent and Trademark Office*